US011779093B2

(12) United States Patent
Kikuchi et al.

(10) Patent No.: US 11,779,093 B2
(45) **Date of Patent: *Oct. 10, 2023**

(54) DEVICE HAVING A SEALABLE CONTAINER FOR A VOLATILE COMPOSITION

(71) Applicant: PT. KEMAS INDAH MAJU CO., LTD., Jakarta (ID)

(72) Inventors: Goro Kikuchi, Chiba (JP); Nata Kumara Dinata, Jakarta Utara (ID)

(73) Assignee: PT. KEMAS INDAH MAJU CO., LTD, Jakarta (ID)

( * ) Notice: Subject to any disclaimer, the term of this patent is extended or adjusted under 35 U.S.C. 154(b) by 1081 days.

This patent is subject to a terminal disclaimer.

(21) Appl. No.: 16/451,215

(22) Filed: Jun. 25, 2019

(65) Prior Publication Data

US 2019/0365074 A1 Dec. 5, 2019

Related U.S. Application Data

(63) Continuation-in-part of application No. PCT/IB2017/001702, filed on Dec. 23, 2017, which (Continued)

(51) Int. Cl.
*A45D 33/24* (2006.01)
*A45D 33/00* (2006.01)

(52) U.S. Cl.
CPC ..... *A45D 33/24* (2013.01); *A45D 33/003* (2013.01); *A45D 33/006* (2013.01); *A45D 33/008* (2013.01); *A45D 2200/051* (2013.01)

(58) Field of Classification Search
CPC .... A45D 33/24; A45D 33/008; A45D 33/006; A45D 33/003
See application file for complete search history.

(56) References Cited

U.S. PATENT DOCUMENTS 4,018,237 A * 4/1977 Steiman ..... A45D 33/006 132/304
5,102,250 A 4/1992 Gueret
(Continued)

FOREIGN PATENT DOCUMENTS

JP H10-286117 A 10/1998
JP H119335 1/1999
(Continued)

OTHER PUBLICATIONS

International Search Report dated Jan. 12, 2015 for International Application No. PCT/US2014/055353, filed Sep. 12, 2014 (2 pages).
(Continued)

*Primary Examiner* — Jeffrey R Allen
(74) *Attorney, Agent, or Firm* — Daniel F. Nesbitt; Nesbitt IP LLC

(57) ABSTRACT

A sealable container for a volatile composition for use in a compact case, having a container having an upper rim and outer thread segments, a compact cover having an annular wall having inner thread segments, and an annular seal disposed between the upper rim of the container and a cover plate of the compact cover. The annular seal has a seal plate having an upper surface, and a seat seal ring that registers with the seal plate and engages the upper rim of the container when the compact covers the container. The seal plate includes a means for preventing the rotative force applied to the upper surface of the seal plate when rotating the compact cover to the second rotated position, to be downward onto the seat seal ring, to prevent tearing, bunching and deforming of the seat seal ring.

20 Claims, 28 Drawing Sheets

Related U.S. Application Data is a continuation-in-part of application No. 15/654,918, filed on Jul. 20, 2017, now Pat. No. 10,159,324.

(60) Provisional application No. 62/439,045, filed on Dec. 25, 2016.

(56) References Cited

U.S. PATENT DOCUMENTS

| | | | |
|---|---|---|---|
| 5,611,362 | A | 3/1997 | Duncan et al. |
| 5,819,764 | A | 10/1998 | Sussman |
| 5,842,486 | A | 12/1998 | Davis et al. |
| 5,845,658 | A | 12/1998 | Sussman |
| 5,950,639 | A | 9/1999 | Suzuki et al. |
| 5,975,093 | A | 11/1999 | Joulia |
| 6,199,559 | B1 | 3/2001 | Nikolaus et al. |
| 6,336,460 | B2 | 1/2002 | Yuhara |
| 6,345,628 | B2 | 2/2002 | Petit |
| 6,526,989 | B2 | 3/2003 | Sheffler et al. |
| 6,923,335 | B2 | 8/2005 | Fujita et al. |
| 8,231,027 | B2 | 7/2012 | Wang et al. |
| 8,464,731 | B1 | 6/2013 | Eberlein et al. |
| 8,678,222 | B2 | 3/2014 | Thorpe et al. |
| 9,210,984 | B2 | 12/2015 | Byeon |
| 9,345,306 | B2 | 5/2016 | Thorpe et al. |
| RE46,854 | E | 5/2018 | Byeon |
| 2006/0151355 | A1 | 7/2006 | Oh |
| 2007/0029226 | A1 | 2/2007 | Yuhara et al. |
| 2011/0020047 | A1 | 1/2011 | Kim |
| 2011/0266297 | A1 | 11/2011 | Thorpe et al. |
| 2012/0305442 | A1 | 12/2012 | Apodaca et al. |
| 2014/0231304 | A1 | 8/2014 | Lee |
| 2014/0283870 | A1 | 9/2014 | Byeon |
| 2015/0320174 | A1 | 11/2015 | Kim |
| 2016/0220007 | A1 | 8/2016 | Montoli |
| 2016/0280426 | A1 | 9/2016 | Kim |
| 2017/0006996 | A1 | 1/2017 | Kim |
| 2017/0099930 | A1 | 4/2017 | Kim |

FOREIGN PATENT DOCUMENTS

| | | | |
|---|---|---|---|
| JP | 2000070031 | A | 3/2000 |
| JP | 2002065355 | A | 3/2002 |
| JP | 2004202109 | A | 7/2004 |
| JP | 2008272064 | A | 11/2008 |
| JP | 2008272240 | A | 11/2008 |
| JP | 2008272246 | A | 11/2008 |
| JP | 2012200281 | A | 10/2012 |
| KR | 2020090002238 | A | 3/2009 |
| KR | 101173162 | B1 | 8/2012 |
| WO | 2005013758 | A1 | 2/2005 |
| WO | 2014080965 | | 5/2014 |
| WO | 2015038871 | A1 | 3/2015 |
| WO | 2016003061 | A1 | 1/2016 |

OTHER PUBLICATIONS

Written Opinion of the International Search Authority dated Jan. 12, 2015 for International Application No. PCT/US2014/055353, filed Sep. 12, 2014 (9 pages).

International Search Report and Written Opinion dated May 29, 2018 for related International Application No. PCT/IB2017/001702, filed Dec. 23, 2017 (12 pages).

International Preliminary Report on Patentability (Chapter I) dated Jun. 25, 2019 for related International Application No. PCT/IB2017/001702, filed Dec. 23, 2017 (8 pages).

* cited by examiner

DEVICE HAVING A SEALABLE CONTAINER FOR A VOLATILE COMPOSITION

CROSS-REFERENCE TO RELATED APPLICATIONS

The present invention is a continuation of PCT Application No. PCT/IB2017/001702, filed Dec. 23, 2017, which claims the benefit of U.S. Provisional Application 62/439,045, filed Dec. 25, 2016, and is a continuation-in-part of U.S. application Ser. No. 15/654,918, filed Jul. 20, 2017, now U.S. Pat. No. 10,159,324 issued Dec. 25, 2018, which also claims the benefit of U.S. Provisional Application 62/439,045, filed Dec. 25, 2016, the disclosures of which are incorporated by reference in their entireties.

BACKGROUND OF THE INVENTION

Historically, cosmetic compacts have been small, flat cases for containing and transporting cosmetic face powder, a powder puff for applying the cosmetic, and a mirror. Typically, compacts were hand sized or smaller cases that could be easily carried in a purse or pocket. Many of these face powders were mineral powders such as talc, often containing mineral pigments. Such mineral powders are typically insensitive to air, containing no components that discolor, decompose, or degrade when exposed to air and containing no volatile materials that could evaporate and damage the consistency of the product. The compacts for such cosmetics were usually flat hinged boxes of various shapes including round, square, oval, or rectangle, consisting of a cover and a base, and had a simple clip holding them closed. While such containers sometimes had a thin paper or plastic seal to prevent the cosmetic from scattering during shipping, this seal was removed and discarded by the consumer before using the cosmetic.

Advances in cosmetic technology and evolutions in packaging have led to the packaging of other types of makeup including eye shadow, lip gloss, rouges, concealers, and new varieties of face powders in small flat containers, some with and some without the associated applicators, and with or without mirrors. All of these containers have been referred to widely as compacts, and many share the same hinged-box construction of the earlier compacts. For the purposes of this patent application, the terms compact and cosmetic case will be used interchangeably to refer to such containers for cosmetics, with or without associated applicators, and with or without a mirror.

Compacts have many advantages, being easy to open and use, convenient to carry, and easy to store and pack. Many of the new cosmetics now being stored and transported in such containers, however, are more sensitive to oxygen, humidity, or air than mineral powders, and cosmetics stored in such containers frequently degrade. Many useful pigments discolor or decompose when exposed to air, and carriers for such pigments frequently contain volatile or air sensitive components. The previous hinged box form of compact is poorly suited for cosmetics containing volatile or air sensitive components. It is desirable, therefore, to provide a compact that retains the advantages of ease of opening and use, convenience of carrying, and ease of storage and packing, while also maintaining a reusable airtight seal to preserve the cosmetics before and between uses. Several attempts have been made to provide an airtight function on a compact, typically by adding additional cover elements inside the compact. In general, providing an airtight function to a container requires either machining the base and the cover of the container from rigid materials to such close tolerances that the fit between the rigid materials leaves no airgaps, or utilizing flexible or elastomeric materials as seals which can be deformed under pressure to fill any openings between the base and the cover. In some designs, a separate inside container is provided, consisting of a cover and a base containing the cosmetic, the inside container fitting into the base of the compact and providing an airtight seal around the cosmetic. In use, the consumer must open first the cover of the compact and then the cover of the inside container to access the cosmetic, and close first the container cover and then the compact cover to store. To maintain the seal on the inside container, the compact lid is provided with either a thread or bayonet-like cam design which locks onto the compact base and applies pressure to the cover of the inside container.

On other airtight compacts, the airtight function is achieved by providing an internal smaller cover that interacts with the base of the compact. In some examples, a flat gasket is pressed between the internal cover and the base to provide an airtight seal. Other examples provide a peripheral gasket such as an O-ring that interacts with a matching element on the base. Still other examples act by pressing a lip molded underneath the internal cover against the base. Similar to examples having a separate inside container, the internal cover is kept in place by the compact cover pressing down on the inside lid and locking on the base by either a thread or a bayonet like cam design. Like compacts with a separate inside container, compacts with internal covers require opening both the compact cover and an interior cover before the cosmetic container can be accessed, and closure of both an interior cover and the compact cover are required for airtight storage.

It is believed that the machined and molded sealing surface of a container and compact cover of a conventional cosmetic compact has an uneven surface microscopically with scratches and cracks that are challenging to seal, and that the use of conventional seal rings and gaskets cannot provide a completely effective seal system to prevent the volatile components from escaping the cosmetic composition/through the seal surfaces between the container and the cover, resulting is volatile component loss sufficient to deteriorate the quality of the volatile compact composition in just a few weeks.

US 2016/0220007 A1, published Aug. 4, 2016, the description of which is incorporated by reference in its entirety, describes a cosmetic case comprising a container having a wall that defines a recess for a cosmetic composition, and a cover assembly consisting of a ring that is free to rotate about the wall and retained by the container, and a cover having a hinge that affixes the cover to the ring. Mating threads on the cover can engage threads on the container so that rotation of the cover assembly draws a sealing gasket inside the cover towards the container rim to form an airtight seal.

However, the same cosmetic case and additional features had been described in Japanese Application 2000-070031, published Mar. 7, 2000, which was granted as Japanese Patent 3,571,931, the descriptions of which are incorporated by reference in their entirety, where a seal member is fixed to the inner surface of the lid member or a top portion of the container wall.

Nevertheless, there remains a need to provide an improved cosmetic case that provides better sealing for volatile cosmetic products.

SUMMARY OF THE INVENTION

The present invention provides a compact case with a sealable container for a volatile composition.

The present invention provides a sealable container for a volatile composition containing a volatile component that can be used in a compact case, as well as a compact case comprising the sealable container.

In an embodiment of the invention, the sealing of the container with the lid of the sealable container is accomplished by threadedly engaging the lid with the container, and the lid of the sealable container is covered and uncovered from the container with a hinge means.

In another embodiment of the invention, the sealable container is replaceable, including insertable and removable, within the compact unit.

In an embodiment of the invention, the sealable container includes a sealing system that includes a circular seal disk disposed between an upper rim of a threaded container and an inside lower surface of a compact cover or lid that threadedly covers the upper rim of the container, and an annular seal material disposed between the annular periphery of the circular seal disk and the annular upper rim of the container. The upper surface of the circular seal disk is configured to remain stationary to allow the inside lower surface of the compact cover to slide rotatively, and relatively, over the stationary upper surface of the circular seal disk. The stationary circular seal disk protects a second seal material, disposed between the upper rim of the container and the under surface of the circular seal disk, from shear forces resulting from the compact cover being threadedly rotated onto the container.

In another embodiment of the invention, a sealable container for a volatile composition is provided for a compact case that includes: i) a container including an annular outer wall, and a floor that define a container space for a volatile composition, and the outer wall having an upper rim, an outer surface and including a series of outwardly-extending thread segments; ii) a hinged ring comprising an annular wall having a lower rim, and a hinge support extending from a portion of said annular wall, and the hinged ring is configured to rotate relative to the container; iii) a compact cover including a cover plate and an annular wall having an inner surface and including a series of inwardly-extending thread segments, and a hinge member extending from a portion of said annular wall to hingedly engage the hinge support of the hinged ring to pivot the compact cover between an uncovered position and a covering position, and wherein at the covering position the compact cover is a first rotated position relative to the container, and the compact cover and the hinged ring can be rotated relative to the container, between the first rotated position at which the thread segments of the compact cover are not engaged with the thread segments of the container, and a second rotated position at which the thread segments of the compact cover are engaged with the thread segments of the container to threaded draw the cover plate axially toward the upper rim of the container to a sealing position; and iv) an annular seal disposed between the upper rim of the container and the cover plate of the compact cover, for forming a sealable container for the volatile composition when the compact cover is threadedly drawn over the container to the sealing position, the annular seal including an seal plate having an upper surface and a lower surface having an outer periphery, and a seat seal ring that registers within the outer periphery of the lower surface of the seal plate, and configured to engage the upper rim of the container in the covering position of the compact cover, the seal plate including a means for preventing rotative force applied to the upper surface of the seal plate when rotating the compact cover to the second rotated position, to be exerted to the seat seal ring.

In another embodiment of the invention, a compact device has a sealable container for a volatile composition. The compact device includes: i) a lower base having an annular frame and an annular track concentric with and surrounding the annular frame; ii) a container that is securable within the annular frame of the lower base, the container including an annular outer wall, and a floor that define a container space for a volatile composition, and the outer wall having an upper rim, an outer surface and including a series of outwardly-extending thread segments and an annular rib extending from the outer surface of the outer wall; iii) a hinged ring comprising an annular wall having a lower rim, and a hinge support extending from a portion of said annular wall, and the hinged ring is configured to rotate the lower rim of the annular wall within the annular track of the lower base; iv) an compact cover including a cover plate and an annular wall having an inner surface and including a series of inwardly-extending thread segments, and a hinge member extending from a portion of said annular wall to hingedly engage the hinge support of the hinged ring to pivot the compact cover between an uncovered position and a covering position, and wherein at the covering position the compact cover is a first rotated position relative to the container, and the compact cover and the hinged ring can be rotated relative to the container, between the first rotated position at which the thread segments of the compact cover are not engaged with the thread segments of the container, and a second rotated position at which the thread segments of the compact cover are engaged with the thread segments of the container to threaded draw the cover plate axially toward the upper rim of the container to a sealing position; and v) an annular seal disposed between the upper rim of the container and the cover plate of the compact cover, for forming a sealable container for the volatile composition when the compact cover is threadedly drawn over the container to the sealing position, the annular seal including an seal plate having an upper surface and a lower surface having an outer periphery, and a seat seal ring that registers within the outer periphery of the lower surface of the seal plate, and configured to engage the upper rim of the container in the covering position of the compact cover, the seal plate including a means for preventing rotative force applied to the upper surface of the seal plate when rotating the compact cover to the second rotated position, to be exerted onto the seat seal ring.

In an embodiment of the means for preventing rotative force, the upper surface of the seal plate has high rotative slippage, and low rotative friction, between the compact cover and the seal plate, which prevents the rotating compact cover from rotating with it the seal plate, and thereby minimizing or eliminating a circumferential shear force upon the seat seal ring. In one embodiment, the seal plate is made of a thermoplastic material that has a low coefficient of friction, and is preferably has a smooth upper surface.

In another embodiment of the means for preventing rotative force, the sealable container can include a slippage sheet disposed between the upper surface of the seal plate, where the slippage sheet comprises a slippage material or surface coating having a high rotative slippage, and low rotative friction, to prevent the rotating compact cover from rotating the seal plate, thereby eliminating any circumferential shear force upon the seat seal ring. In one embodiment, the slippage sheet is made of a low-friction, non-stick and durable material. Examples of the slippage sheet material or coating is a synthetic fluoropolymer, such as polytetrafluoroethylene (TEFLON™).

In another embodiment of the means for preventing rotative force, the seal plate includes a plurality of projections that engage and bayonet into a plurality of slots formed into an annular flange of the upper rim of the container, to prevent the rotating compact cover from rotating the seal plate, and thereby eliminating any circumferential shear force upon the seat seal ring. When the compact cover is threadedly closed over the threaded container, the seal plate and its upper surface remain stationary, held in place against rotation by the slot in the upper rim of the container retaining the projections of the seal plate. This allows the inside lower surface of the compact cover to slide rotatively, and relatively, over the stationary upper surface of the seal plate, and protects the seal plate, which is disposed between the upper rim of the container and the under surface of the seal plate, from shear forces resulting from the compact cover being threadedly rotated onto the container.

In an embodiment of the invention, the lower base includes an annular inner tray disposed outerward radially of the hinged ring, the inner tray having a slot within which the hinge support of the hinged ring can rotate relative to the container between the first rotated position and the second rotated position.

In an embodiment of the invention, the container and the seal plate is made of a resilient thermoplastic material, which can be selected from the group consisting of polypropylene (PP) high-density polyethylene (HDPE), polyethylene terephthalate (PET), polyethylene terephthalate-glycol modified (PTG or PETG), and an impact-modified acrylonitrile-methyl acrylate copolymers, available under the tradename BAREX®.

In an embodiment, the seat seal ring is made of a silicon material, a urethane material, or a rubber material that can include nitrile rubber (NBR), and is preferably a pliable or elastic material that can elastically conform to a seal surface of the upper rim of the container and the seal plate.

In an embodiment of the invention, the compact device further includes an upper outer cover that is hinged to the lower base, to cover the sealable container.

In an embodiment of the invention, wherein the lower base, the container, the hinged ring, the compact cover, and the annular seal each have a rotative centerline that align with a common centerline.

In an embodiment of the invention, the series of outwardly-extending thread segments of the container are circumferentially spaced apart and separated by a corresponding series of gaps, wherein the series of inwardly-extending thread segments of the compact cover are angularly aligned with the series of gaps of the container when the compact cover is in the covering position, and the compact cover and the hinged ring are in the first rotated position relative to the container, and the inwardly-extending thread segments of the compact cover are angularly aligned with the series of outwardly-extending thread segments of the container when the compact cover and the hinged ring are in the second rotated position relative to the container.

In an embodiment of the invention, the compact case includes (a) a base including an outer wall having a hinge window, and an upper opening, (b) a container having an outer wall with thread connections and having a top opening, securable in a fixed position onto a base floor of the base, and extending through the upper opening of the base, (c) an annular hinge ring disposed within the base between the outer wall and the container, and rotatable around the container between a closed position and an openable position, the hinge ring including an cylindrical inner wall, a platform extending from an upper edge of the inner wall and having an outer periphery, a hinge member extending radially outward from the inner wall, and a veil wall that extends downward from a portion of the outer periphery, and is disposed along the periphery to cover and inside of the hinge window of the base when the hinge ring is in a closed position, and (d) a cover including a cover plate and an annular wall, and a hinge member extending from a portion of said annular wall to hingedly engage the hinge member of the hinged ring to form a hinge for pivoting the cover between an uncovered position and a covering position, wherein at the covering position, the cover and the hinge ring can rotate relative to the container between: a rotative closed position at which the veil wall covers the hinge window of the base, and a rotative openable position, at which the hinge is in registry with the hinge window. At the rotative openable position, the cover can be pivoted between a covering position disposed over the top opening of the container, and uncovered position at which the hinge extends radially through the hinge window of the base.

In another embodiment, a compact case includes a container assembly and a hinged cover assembly that is retained to and rotatable about a central axis relative to the container assembly. The container assembly comprises (a) a base including an outer wall having a hinge window, and an upper opening, and (b) a container having an outer wall with thread connections and having a top opening, securable in a fixed position onto a base floor of the base, and extending through the upper opening of the base. The hinged cover assembly comprises: (a) an annular hinge ring including an annular inner wall, a platform extending from an upper edge of the inner wall and having an outer periphery, a hinge member extending radially outward from the inner wall, and a veil wall that extends downward from a portion of the outer periphery, and (b) a cover including a cover plate and an annular wall, and a hinge member extending from a portion of said annular wall to hingedly engage the hinge member of the hinged ring to form a hinge for pivoting the cover between an uncovered position and a covering position, wherein the hinge ring is disposed within the base between the outer wall and the container, and the hinged cover assembly is rotatable around the container between a closed position and an openable position. At the rotative closed position, the veil wall covers the hinge window of the base. At the rotative openable position, the hinge is in registry with the hinge window, and the veil wall is out of registry with the hinge window. When the cover is in the rotative openable position, the cover can be pivoted by the hinge between a covering position disposed over the top opening of the container, and an uncovered position.

In a further embodiment, the veil wall is disposed circumferentially adjacent to the hinge member of the hinge ring.

In another embodiment of the invention, the compact case includes a hinge ring that is hinged to the cover through a hinge, and includes a veil wall extending from a periphery of the hinge ring, wherein the hinged cover and hinge ring are rotatable between a position where the hinge of the hinged cover and hinge ring is in registry with the hinge window, and a closed position where the hinge of the hinged cover and hinge ring is out of registry with the hinge window, and the veil wall is in registry with and covers an inside of the hinge window.

In another embodiment of the invention, a vapor seal layer can be included as a seal sheet, over and covering the rim or top edge of the container, that is more impervious to organic solvent vapor and water vapor than conventional structure thermoplastic materials. The vapor seal layer can consist of a sheet of a resilient thermoplastic material having a high vapor diffusion barrier property, that is registered over the upper rim of the container to form an effective vapor seal at the rim, and a diffusion barrier against diffusion of volatile solvent vapors out through the covering components of the container.

DETAILED DESCRIPTION OF THE INVENTION

Figure 1A:
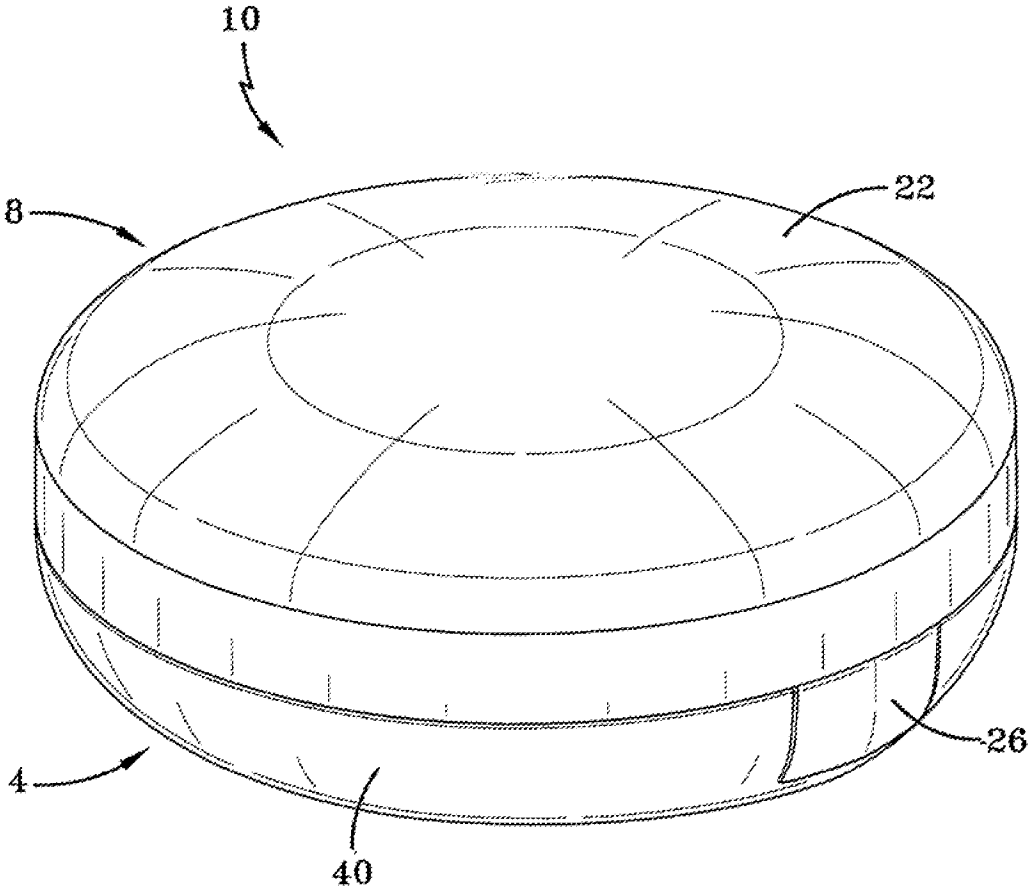
FIGS. 1*a* and 1*b* show a compact case having a replaceable sealable container for a volatile composition.
Figure 1B:
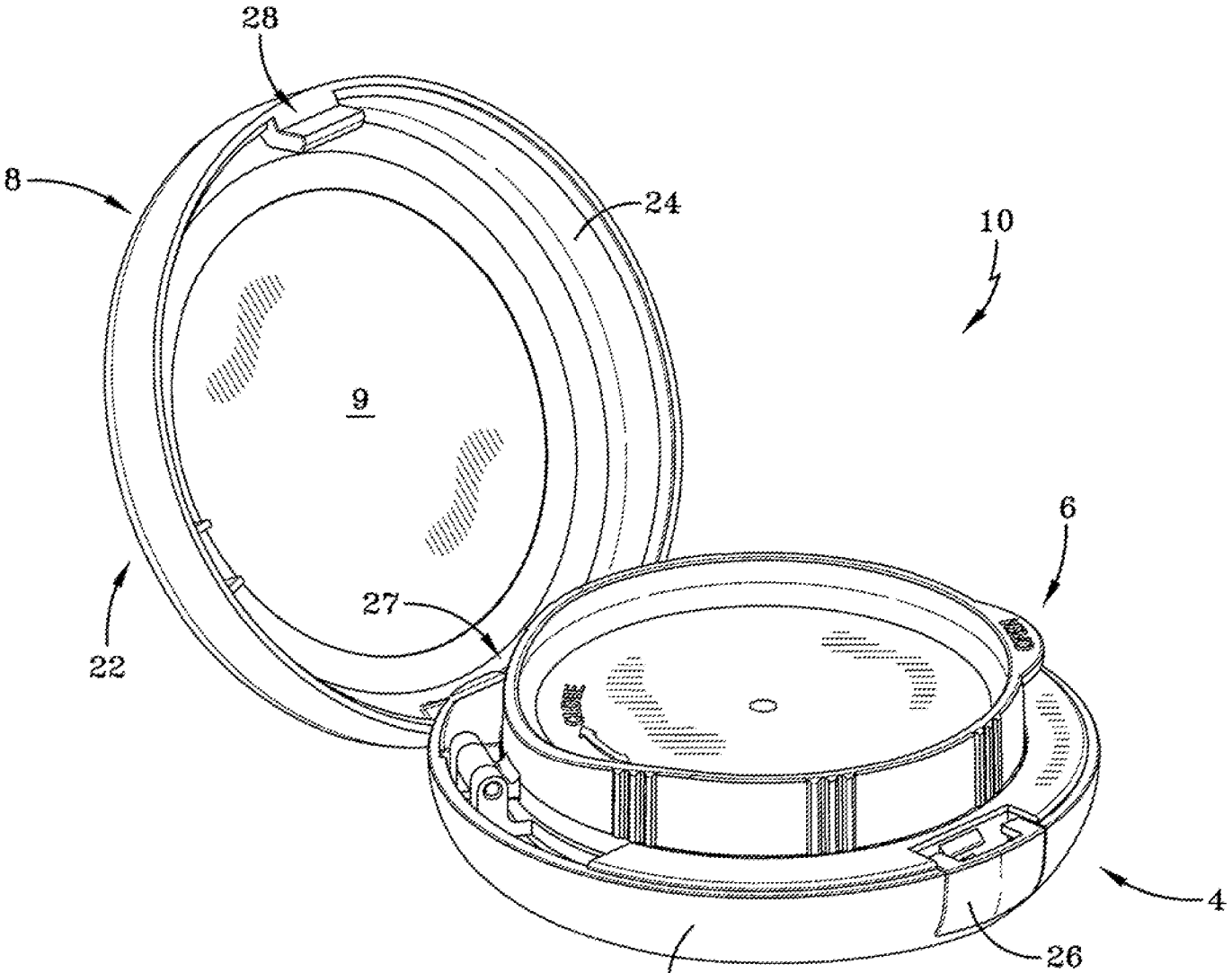

FIGS. 1*a*, 1*b*, 2 and 3 show a compact 10 including a lower base unit 4 that hinges and clasps to an upper cover unit 8 to form a case, and a replaceable sealable container 6 for a volatile composition. The lower base unit 4 has a push-button 26 that includes a catch 48 on the upper cover 22 to form an opening means 47 for the upper cover 22. The lower base unit 4 also includes a hinge means 45 that cooperates with a hinge means 27 of the upper cover 22 to pivot the upper cover 22 between an open position shown in FIG. 1*b*, and a closed position shown in FIG. 1*a*.

Figure 3:
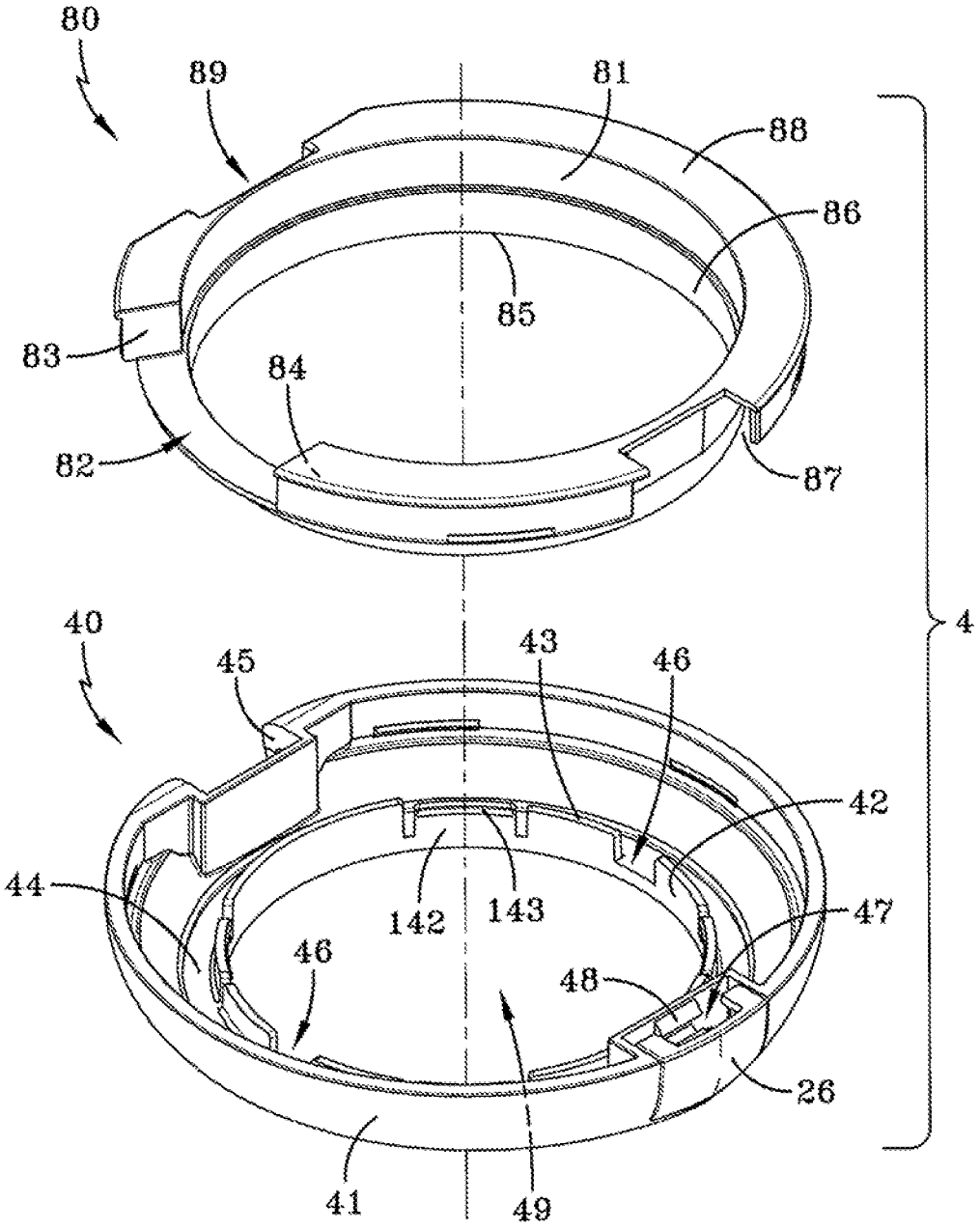
FIG. 3 shows an exploded view of the lower base unit.

FIG. 3 shows an exploded view of the lower base unit 4 that includes a lower base 40, and an inner tray 80 including an upper annular segment including an inner wall 81 and top surface 88, and a lower wall 86 having a lower edge 85. The lower base 40 includes an outer wall 41 and in inner annular frame 42 that includes an upper rimmed edge 43 and a slot 46. The sealable container 6 includes container 50 of the volatile composition, and a hinged, rotatable lid 70 that seals a top opening of the volatile composition container 20. The sealable container 6 is held in the annular frame 42 of the lower base 40. When the sealable container 6 is inserted down into the opening of the annular frame 42, an annular side rib 59 of the container 50, shown in FIG. 4, engages and is supported on the upper edge 43 of the frame 42 of the lower base 40. A post 56 on the container 50, below the annular side rib 59, aligns with and extends radially outwardly into the slot 46 of the frame 42 to prevent axial rotation of the container 50 while retained by the annular frame 42 of the lower base 40.

Figure 5A:
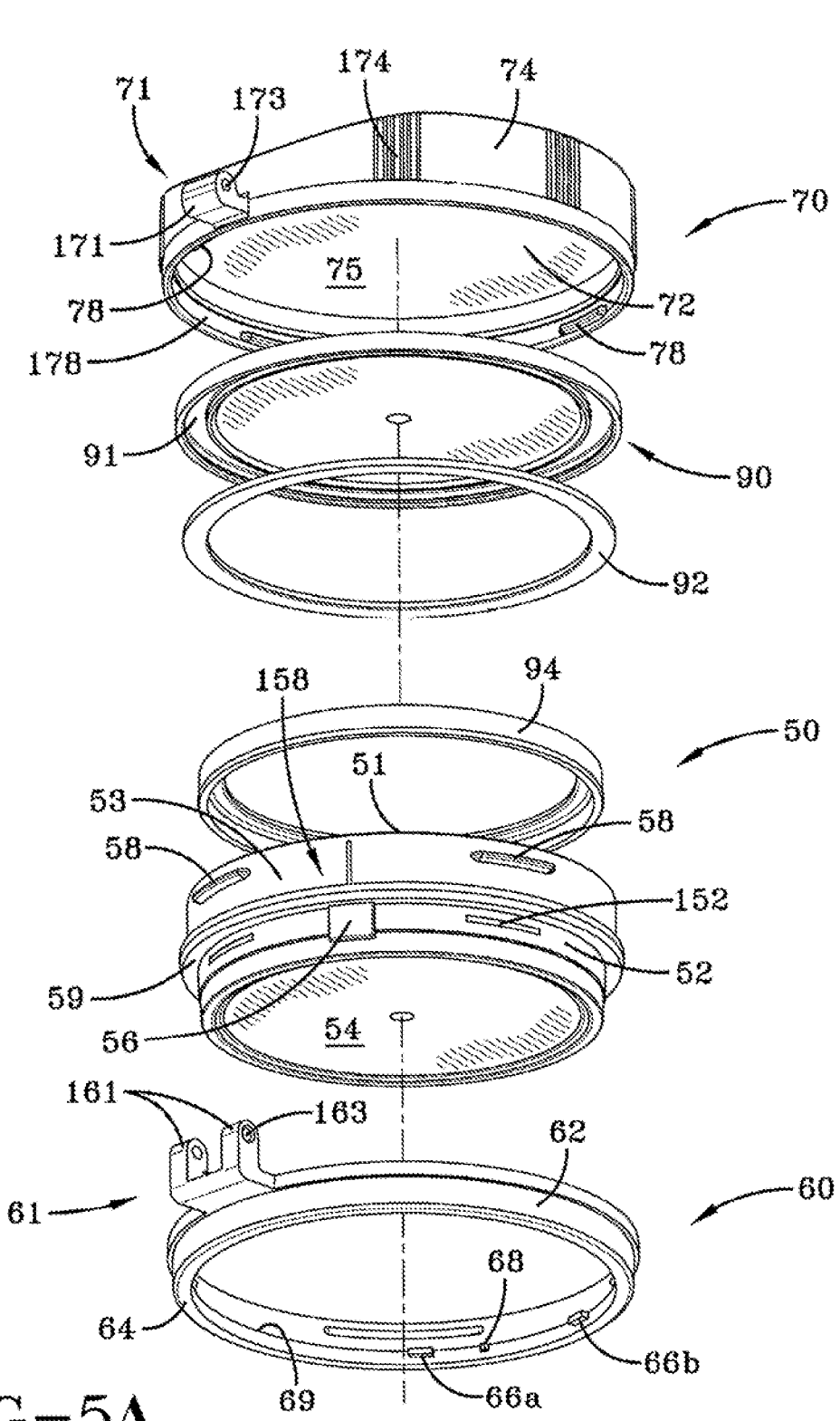
FIG. 5A shows an exploded bottom view of the components of the sealable container.

As shown in FIGS. 3 and 5, the frame 42 includes an inwardly extending ledge 143 at the upper rimmed edge 43 of a segment 142. When the container 50 is being inserted down into the frame 42, the outer surface of the lower wall 52 of the container 50 biases the ledge 143 and the wall segment 142 radially outwardly, until the ledge 143 drops into a recessed slot 152 in the lower wall 52 of the container 50, to retain the container 50 in its inserted position within the lower base 40.

Figure 2:
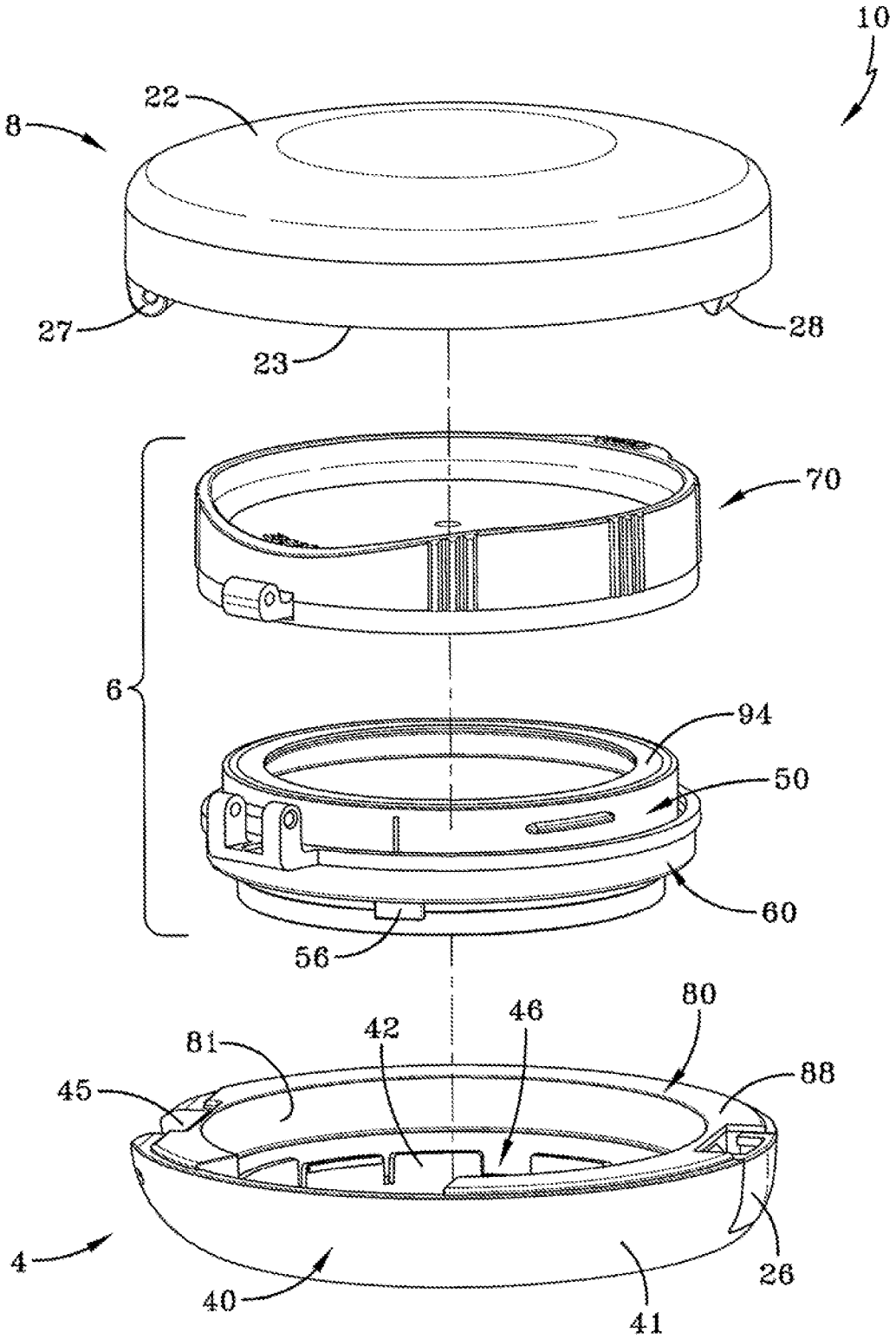
FIG. 2 shows an exploded view of the compact case have a lower base unit that hinges to an upper cover unit, and the sealable container having a hinged, rotatable lid that seals the volatile composition container.

As shown in FIGS. 1*a* and 2, the upper cover 22 includes an annular wall 24 having a lower rim 23, a hinge means fixed on one side of the annular wall 24, and the latch 28 for securing to a catch 48 of the lower base 40 to close the upper lid 22 over the lower base unit 22 as shown in FIG. 1*a*. The push button 26 is biased radially outwardly. When the push button 26 is depressed inwardly, a post on the inside of the push button 26 biases the catch 48 inwardly, thereby releasing the latch 28. The upper cover 22 can also include a mirror 9 fixed to an inner surface.

As shown in FIG. 3, the inner tray 80 has a hinge relief section 89 formed into the upper segment to receive the hinge means 45 of the lower base 40, and a catch relief section 87 formed into the upper segment to expose the opening means 47 and push button 26 of the lower base 40.

Figure 4:
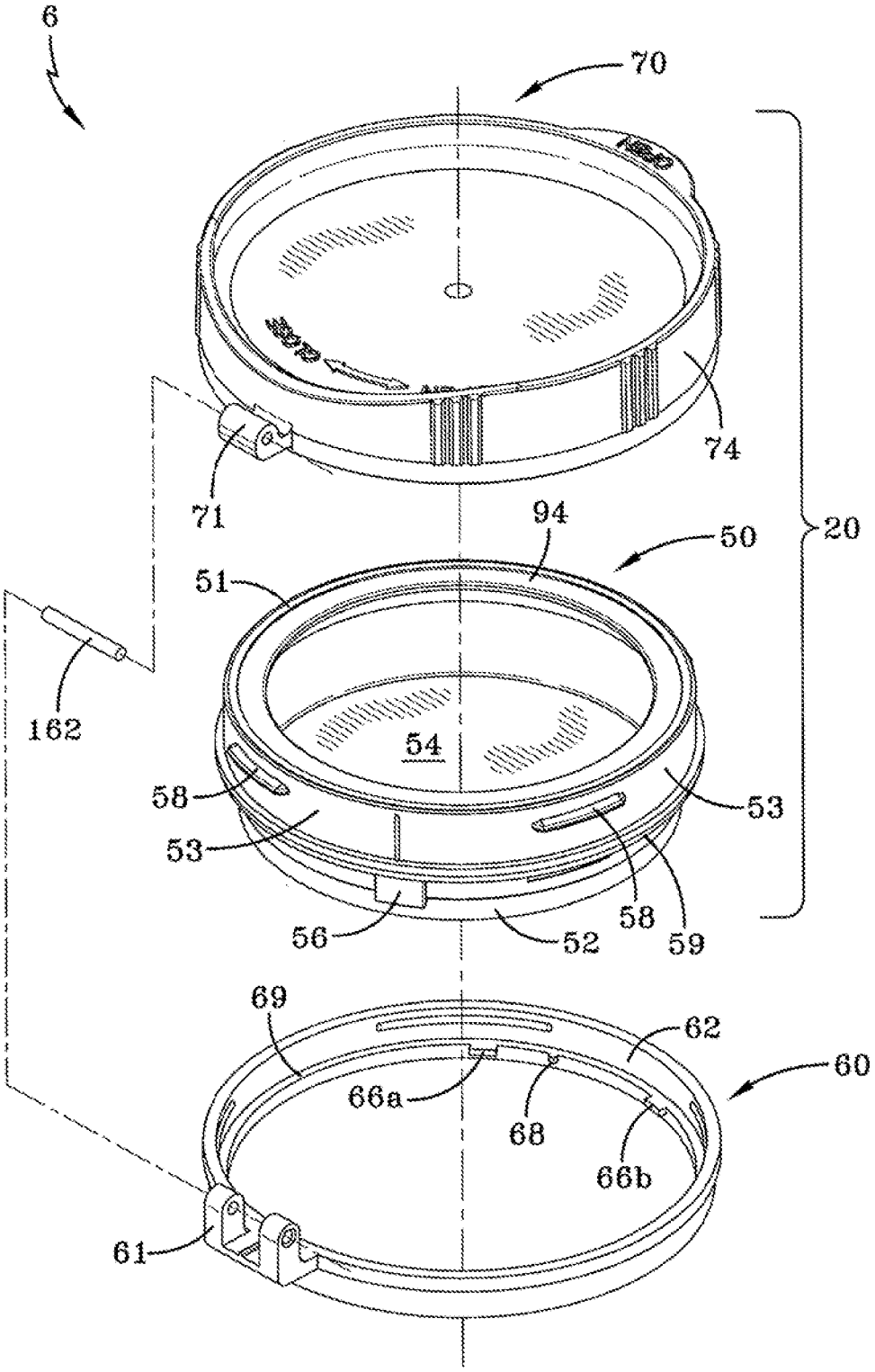
FIG. 4 shows an exploded top view of main portions of the sealable container.
Figure 5B:
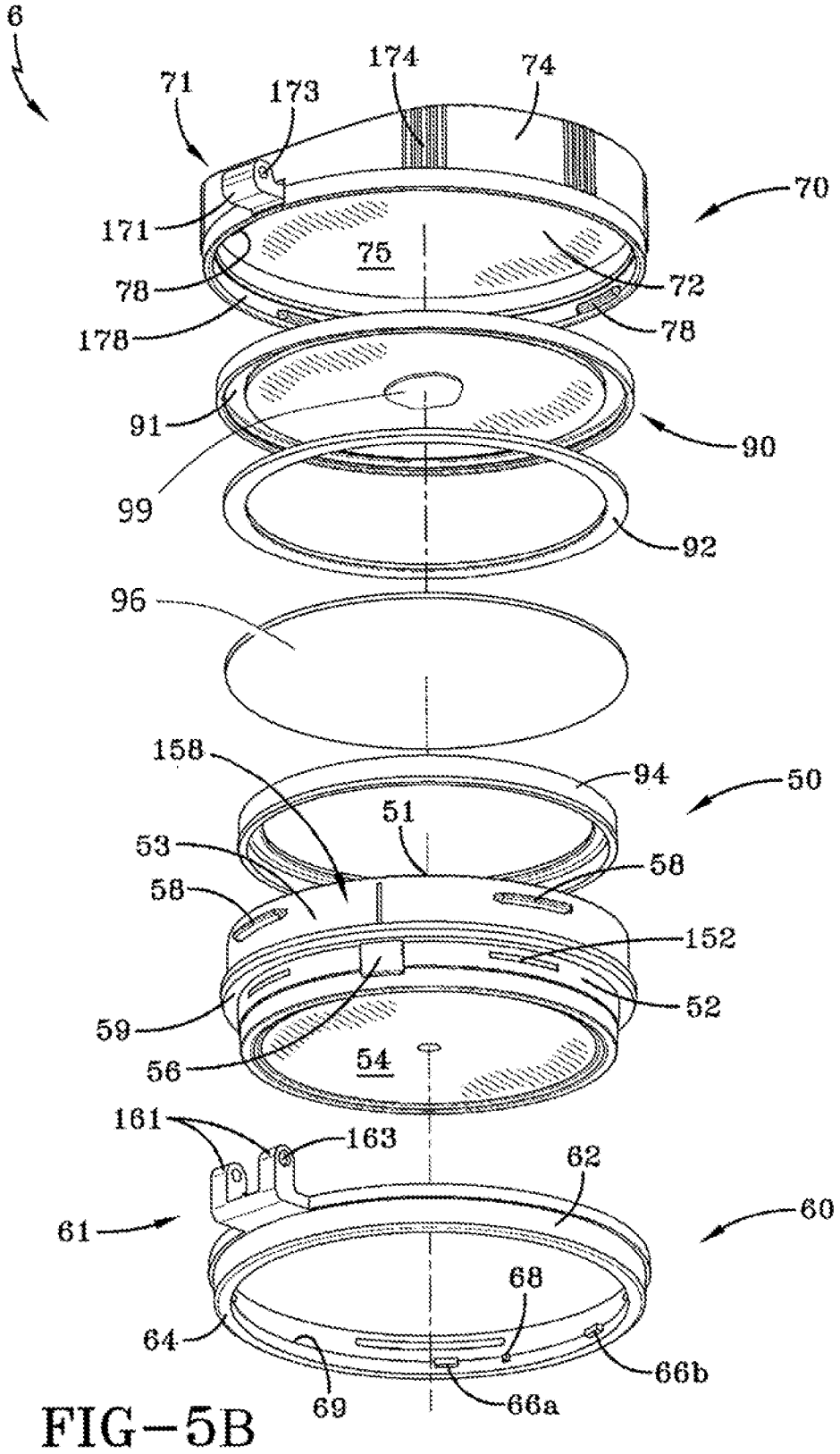
FIG. 5B shows an exploded view of the components of an alternative embodiment of the sealable container.
Figure 6:
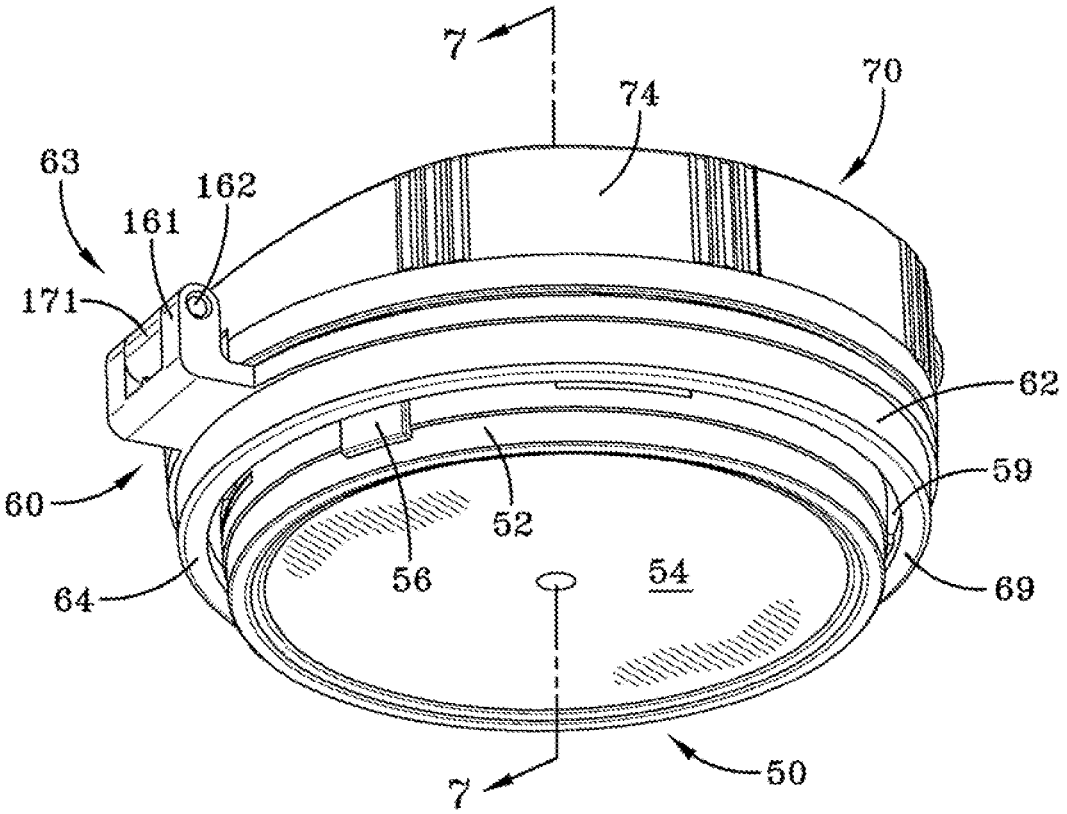
FIG. 6 shows a view of the sealable container with the hinged lid in a position covering the top of the container.

FIGS. 4, 5 and 6 show the sealable container 6 and its portions and components. A volatile component container 50 includes an annular wall and a closed bottom 54, the annular wall including a lower wall 52 and an upper wall 53. The annular rib 59, discussed above, extends from the annular wall and separates the lower wall 52 from the upper wall 53. The upper wall 53 includes a plurality of outwardly-extending thread segments 58 distributed evenly around the circumference. Each of the thread segments 58 align along a helical or slanted path, and define an arcuate space 158 between the successive thread segments 58. The length of the plurality of thread segments 58 can be short relative to the arcuate spaces 158.

The container 50 also has a circular upper rim 51 having a narrow, annular, planar upper surface that defines a seal surface that requires sealing to prevent the escape of volatile components from the volatile compact composition within the container 50, along the upper rim 51.

The compact cover or lid 70 is configured to be threadedly secured to the top opening of the container 50 to close and seal against the upper rim 51 of the container 50. The compact cover 70 includes a cover plate 72 with an inside surface 75 and an outer surface, and an annular outer wall 74. The outer wall 74 extends downward from the periphery of the cover plate 72. A plurality of projections 174 are disposed on the outer surface of the outer wall 74 to provide a gripping means for a user to grasp and rotate the compact cover 70. The outer wall 74 also includes a plurality of inwardly-extending thread segments 78 distributed evenly around the circumference. Each of the thread segments 78 align along a helical or slanted path, and define an arcuate space 178 between the successive thread segments 78. The length of the plurality of thread segments 78 can be short relative to the arcuate spaces 178.

Figure 8:
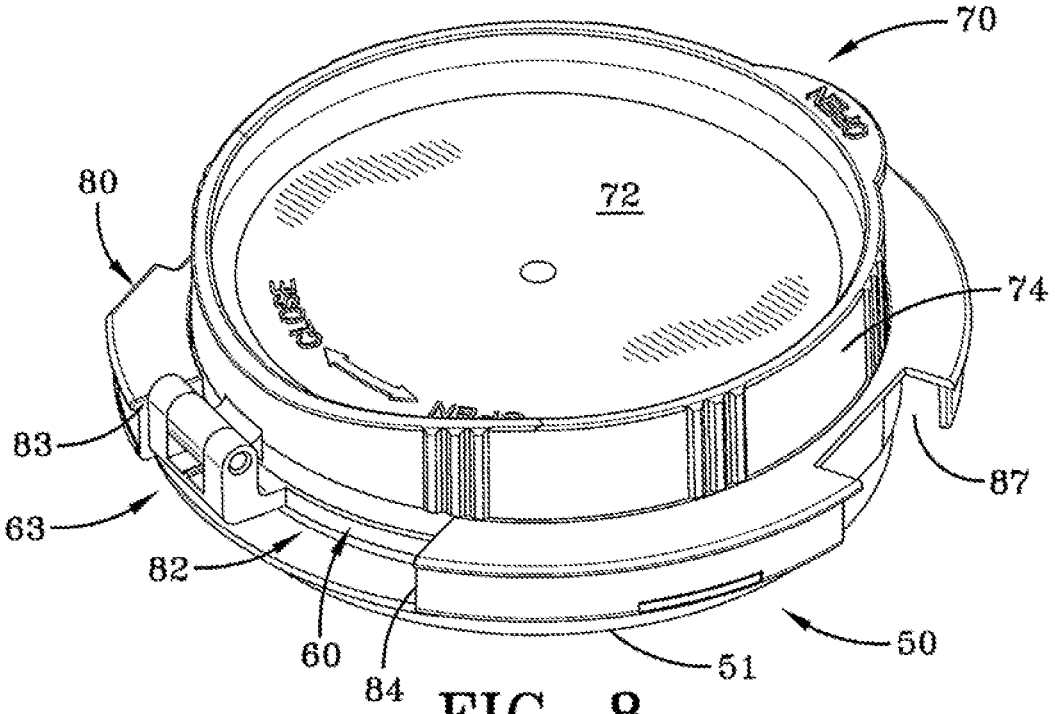
FIG. 8 shows a top view of the sealable container with the hinged lid in a covered position and in a rotated position where the lid is threaded engaged with the container.

The thread segments 78 of the compact cover 70 are congruent with the thread segments 58 of the container 50, so that when the compact cover 70 is placed over the top opening of the container 50 in the first rotated position illustrated in FIG. 8, the thread segments 78 of the compact cover 70 register circumferentially with the spaces 158 between successive thread segments 58 of the container, and thread segments 78 of the compact cover 70 are not engaged with the thread segments 58 of the container 50. The thread segments 78 on the inner surface of the outer wall 74 are positioned axially to place the thread segments 78 axially below the thread segments 58 of the container 50, so that when the compact cover 70 is rotated ("R") relative to the container 50 to the second rotated position as illustrated in FIG. 9, the thread segments 78 engage the underside of the thread segments 58 of the container 50, causing the compact cover 70 to draw downward axially over the upper rim 51 of the container 50 to the sealing position.

Figure 9:
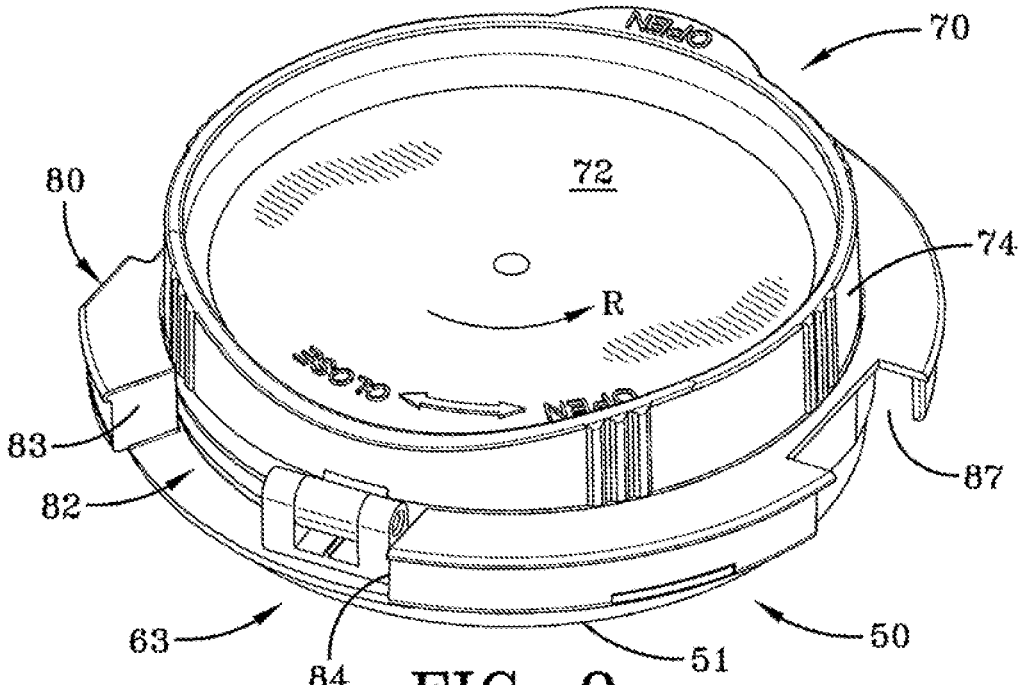
FIG. 9 shows the sealable container of FIG. 8 where the hinged lid has been rotated to a position where the lid is not threaded engaged with the container.

FIGS. 8 and 9 also show the inner tray 80, for clarity, separated from the lower base unit 40, and associated with sealed container 20. The inner tray 80 also has an arcuate slot 82 formed into the inner wall 81 and the top surface 88 of the upper segment, to define a first slot face 83 and a second slot face 84. The slot 82 provides an arcuate space for the container hinge 63 to pivot between its first rotated position adjacent the first slot face 83, as shown in FIG. 8, and its second rotated position adjacent the second slot face 83, as shown in FIG. 9.

Figure 7A:
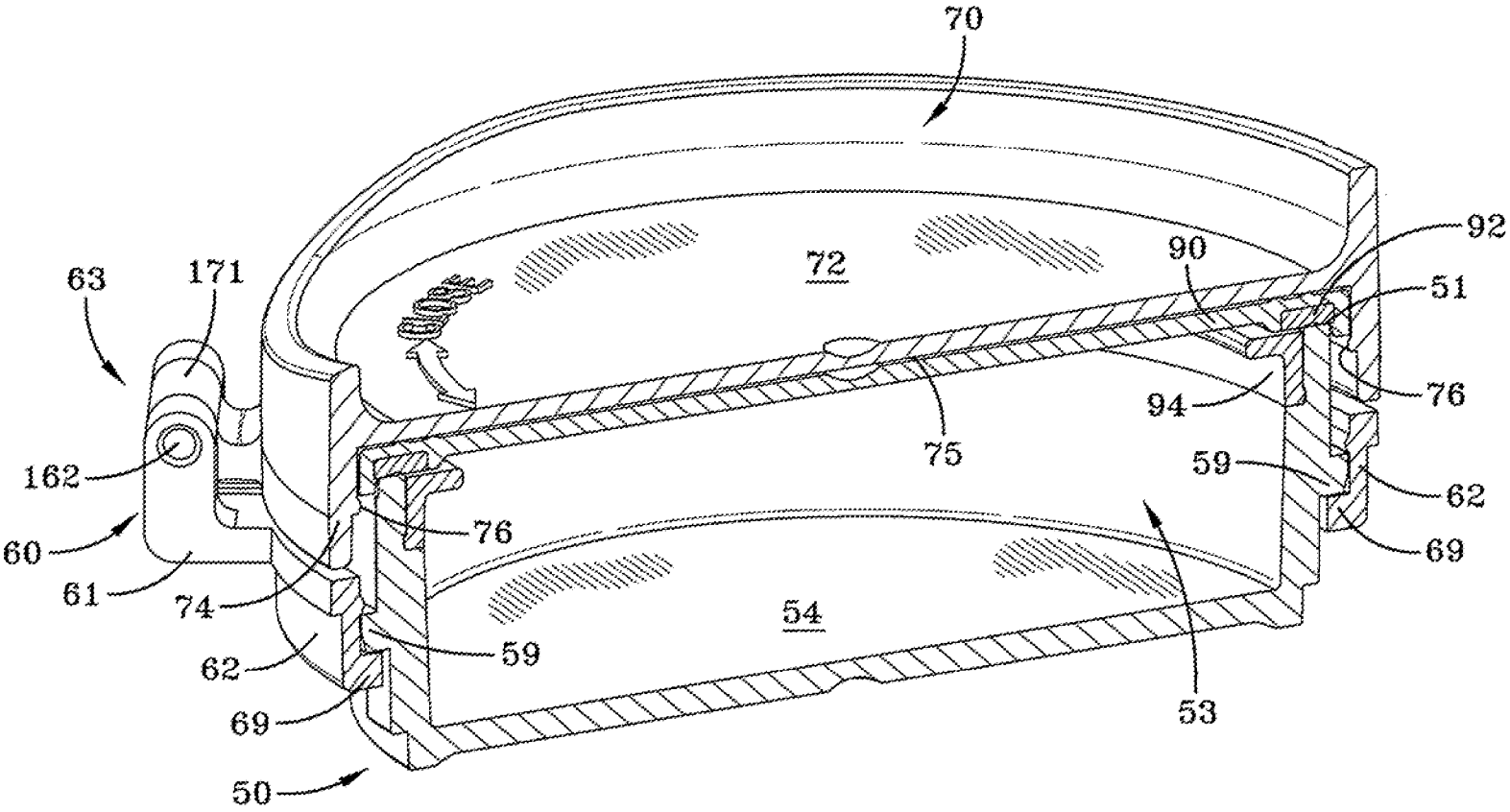
FIG. 7A shows a sectional view of the sealable container viewed through line 7-7 of FIG. 6.
Figure 7B:
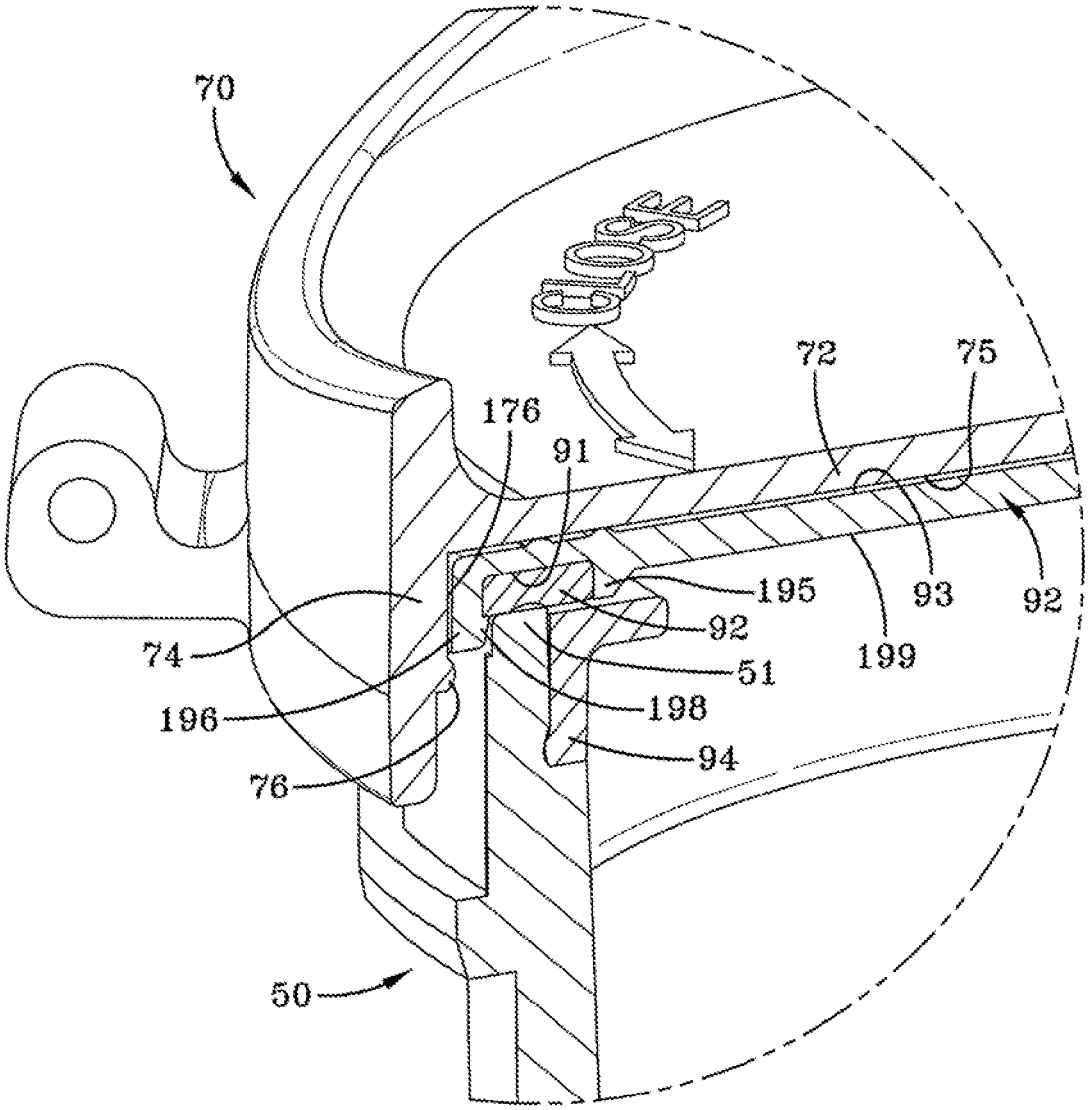
FIG. 7B shows a detailed view from the sectional view of the sealable container of FIG. 7A.

The sealed container 6 includes a seal system disposed between the upper rim 51 of the container 50 and the inside surface of the cover plate 72 of the compact cover 70. An effective sealing of the container 50 inhibits or prevents a volatile solvent of the cosmetic composition in the container space 55 from escaping over time. Excessive loss of solvent can result in a thickening, hardening or drying of the cosmetic composition. The seal system uses a sealant material that has low vapor diffusivity and conforms to the seal surfaces of the container 50 and the compact cover 70. As shown in FIGS. 5, 7A and 7B in a first embodiment of the invention, the threaded seal system includes a seal plate 90 having an outer periphery, and a seat seal ring 92 that registers within a groove 91 on the underside of the outer periphery of the seal plate 90. In the illustrated embodiment, the seal plate 90 is a circular disk, typically made of a resilient thermoplastic material, preferably having low vapor diffusivity. The compact cover 70 also includes an annular inner rib 76 that extends a minimal distance radially inwardly away from the inner surface of the outer wall 74, and a fixed axial distance from the inside surface 75 of the cover plate 72 to define an annular groove 176 there between, as shown in FIG. 7B. An annular outer flange 196 of the seal plate 90 is retained rotatably within the groove 176 of the compact cover 70 by the annular rib 76, so that the seal plate 90 remains with the compact cover 70 during product use.

The annular outer flange 196 itself includes an annular ledge 198 projecting inwardly from its lower edge, and a second ridge 195 extending from an under surface 199 of the seal plate 90 to define an annular flat groove 91. The peripheral edge of the seat seal ring 92 is retained within the groove 91 by the annular ledge 198.

The sealable container also includes a sponge ring 94 for retaining a sponge applicator within the container 50.

A feature of the seal plate 90 is an upper surface 93 that confronts against the inner surface of the compact cover 70. The upper surface 93 has a minimal frictional interface that allows the cover plate 72 to rotatably slip or slide relative to the seal plate 90. When the inside surface 75 of the plate 72 of the compact cover 70 is threadedly rotated onto the upper rim 51 of the container 50, the upper rim 51 of the container 50 exerts a vertical upward compressive force on the seat seal ring 92, which presses the seat seal member 92 into the groove 91 of the seal plate 90, to seal the seat of the groove 91. The inside surface 75 of the plate 72 of the compact cover 70 exerts both a vertical downward compressive force and a circumferential (rotative) shear force against the upper surface 93 of the seal plate 90. The groove 91 of the seal plate 90 engages with the seat seal ring 92. To avoid the circumferential (rotative) shear force from acting on the seat seal ring 92, the low coefficient of friction of the upper surface 93 of the seal plate 90 effects relative rotational slippage between the upper surface 93 of the seal plate 90 and the inside or lower surface 75 of the cover plate 72. This prevents the seal plate 90 from rotating with the rotating compact cover 70, and thereby eliminates any circumferential shear force upon the seat seal ring 92, which prevents tearing, bunching and deforming of the seat seal ring 92.

In an embodiment of the invention, the seat seal ring 92 is an annular ring of sealant material, and in an alternative embodiment can be a circular disk. The seat seal ring 92 can be a silicone material, a urethane seal material, or a rubber material that can include nitrile rubber (NBR), which have sufficient seal properties and pliability to form an effective vapor-proof seal against both the upper rim 51 of the container 50 and the seal plate 90, and to seal in the volatile components of the cosmetic composition when the compact cover 70 is threaded down and over the container 50.

Figure 7C:
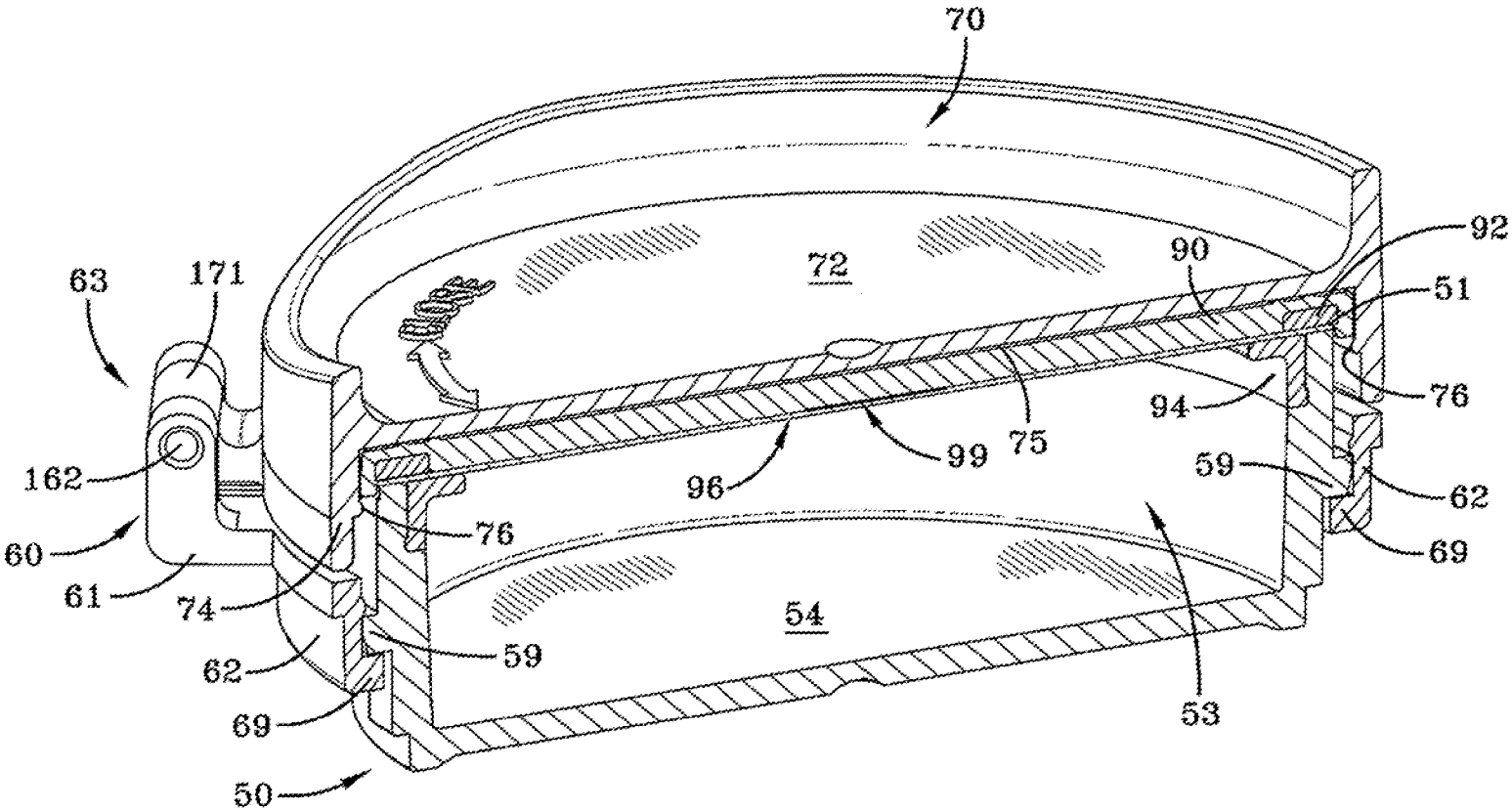
FIG. 7C shows a sectional view of the alternative embodiment of the sealable container, as through line 7-7 of FIG. 6.
Figure 7D:
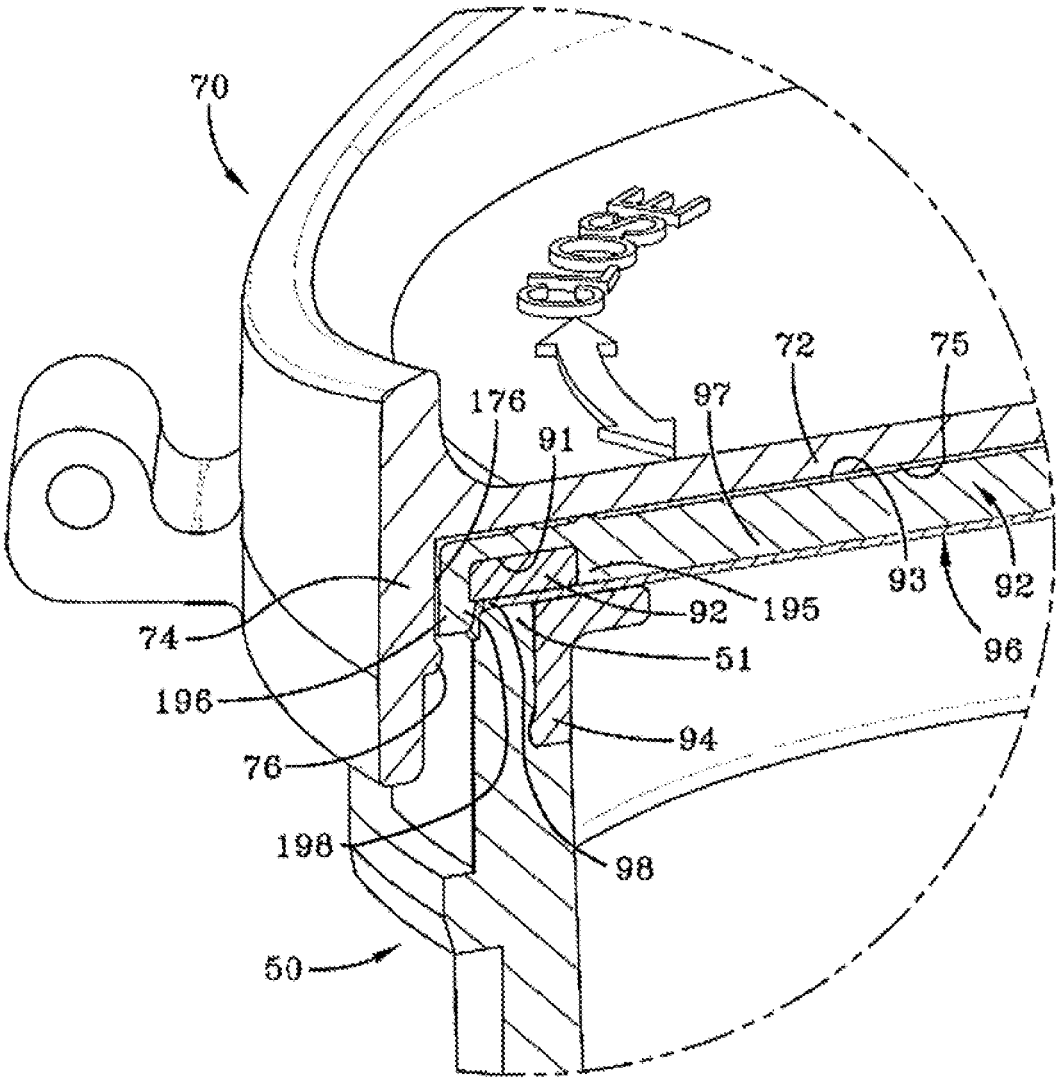
FIG. 7D shows a detailed view from the sectional view of the sealable container of FIG. 7C.

In another embodiment of the invention, a vapor seal layer 96, shown in FIGS. 5B, 7C and 7D, is provided that consists of a sheet of a resilient thermoplastic material that has a high vapor diffusion barrier property, that is more impervious to organic solvent vapor and water vapor than conventional structure thermoplastic materials.

The vapor seal layer 96 comprises a solid continuous film, without pores or openings, and has a periphery 98 that extends radially to register between the seat seal ring 92 and the upper rim 51 of the container 50. When the cover 70 is threadedly secured down and over the container 50, the periphery 98 forms an effective vapor seal at the rim 51, while the resilient seat seal ring 92 is pressed downwardly by the cover 70 and seal plate 90 against the upper surface 97 of the vapor seal layer 96 at the periphery 98.

In another embodiment of the invention, a vapor seal layer 96 can be made of nylon, polyethylene terephthalate glycol (PETG), vacuum metalized polyethylene terephthalate (PET), or other materials that has a relatively higher vapor diffusion barrier property as compared to that of the material of the seal plate 90 made of polypropylene (PP).

Without being bound by any particular theory, the resilient seat seal ring 92, particularly when using a material like silicone, can be slightly pervious to organic vapors and/or moisture (water vapor), even while provide excellent gas and liquid sealing. A seat seal ring 92 consisting of a silicon gasket seal has been tested to withstand more than 60 cm Hg vacuum environment, without leaking the volatile content. However, when the container is filled with a volatile compound (for example, 98% ethanol) under room conditions, and is subjected to an aging test under elevated temperature (50° C.), a subtle but constant rate decrease in the bulk weight of the volatile compound was observed. It is believed that solvent vapor or moisture vapor can diffuse at a slow but appreciable rate through the radial thickness of the seat seal ring 92. The vapor seal layer 96 significantly reduces or eliminates diffusion of the solvent vapors through the covering components of the container 50, while also forming an effective vapor (and liquid) seal along the rim 51 of the container 50.

The upper surface 97 of the vapor seal layer 96 is affixed, such as with an adhesive material 99 applied to the inside surface 199 of the seal plate 90, to prevent lateral movement of the vapor seal layer 96 and prevent the vapor seal layer 96 from rotating relative to the seal plate 90 and seat seal ring 92.

In a test using metalized PET as a vapor seal layer, it was observed that the rate at which the subtle weight loss occurs (in the aging test) decreased by a factor of 4. Ultimately, the limiting and decreasing of the diffusion rate is dictated by the gas diffusion coefficient of the material used to form the container and covering components that enclose the volatile component. If a material such as aluminum or glass, which has a much lower gas diffusion property (higher barrier property) is used, as opposed to a more conventional thermoplastic material, the rate of weight loss of the volatile component would be expected to decrease even further, to a much more insignificant level.

The plastic material of the container 50 and the seal plate (or disk) 90 is preferably a thermoplastic material having a low vapor diffusivity, to minimize loss of volatile solvents and other volatile components through the bodies of the container 50 and seal plate 90 by diffusion. The seal system provides a compact product that can minimize solvent and other volatile component loss and maintain the quality of the composition for much longer times than can a conventional compact.

In the illustrated embodiment, the seal plate and the seat seal ring are distinct parts, configured to cooperate to form a seal component of the threaded seal system. In another embodiment, the seal plate and the seat seal ring can be manufactured as an integral part. For example, the material of the seat seal ring can be over-molded onto a molded seal plate, by well-known means.

A further component of the seal container 6 is a hinged ring 60. The hinged ring 60 includes an annular wall 62 and a hinge support 61 extending from a portion of the wall 62. The hinge support 61 associates with the hinge member 71 of the compact cover 70 to form a container hinge 63. In the illustrated embodiment, the hinge support 61 includes a pair of laterally spaced-apart support lugs 161 with a lateral bore 163 through each support lug 161, and the hinge member 71 includes an extending lid lug 171 with a lateral bore 173 there through. A pin 162 is press-fit through bores 163 of each of the pair of support lugs 161 and the bore 173 of the lid lug 171 to form the pivoting hinge 63 of the compact cover 70 relative to the hinged ring 60.

Figure 10:
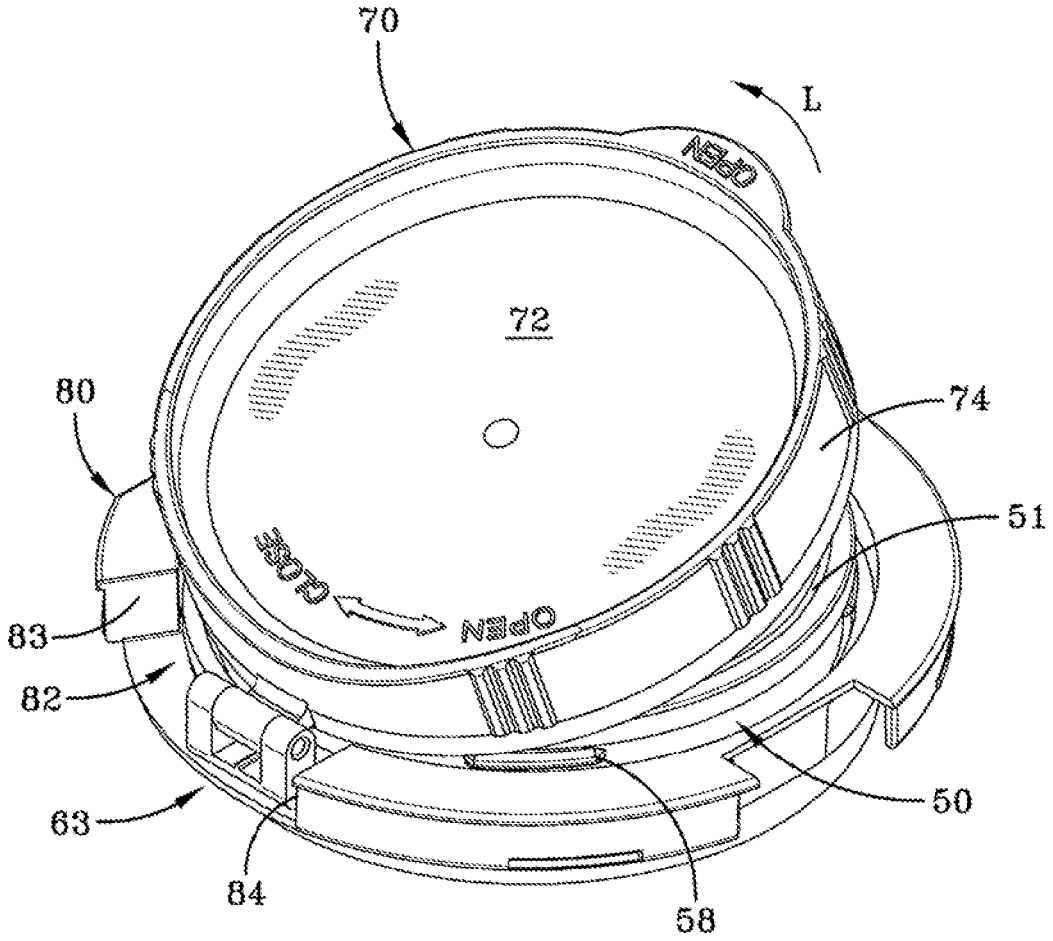
FIG. 10 shows the sealable container of FIG. 9 where the hinged lid has been lifted from the covered position toward an uncovered, open position.
Figure 11:
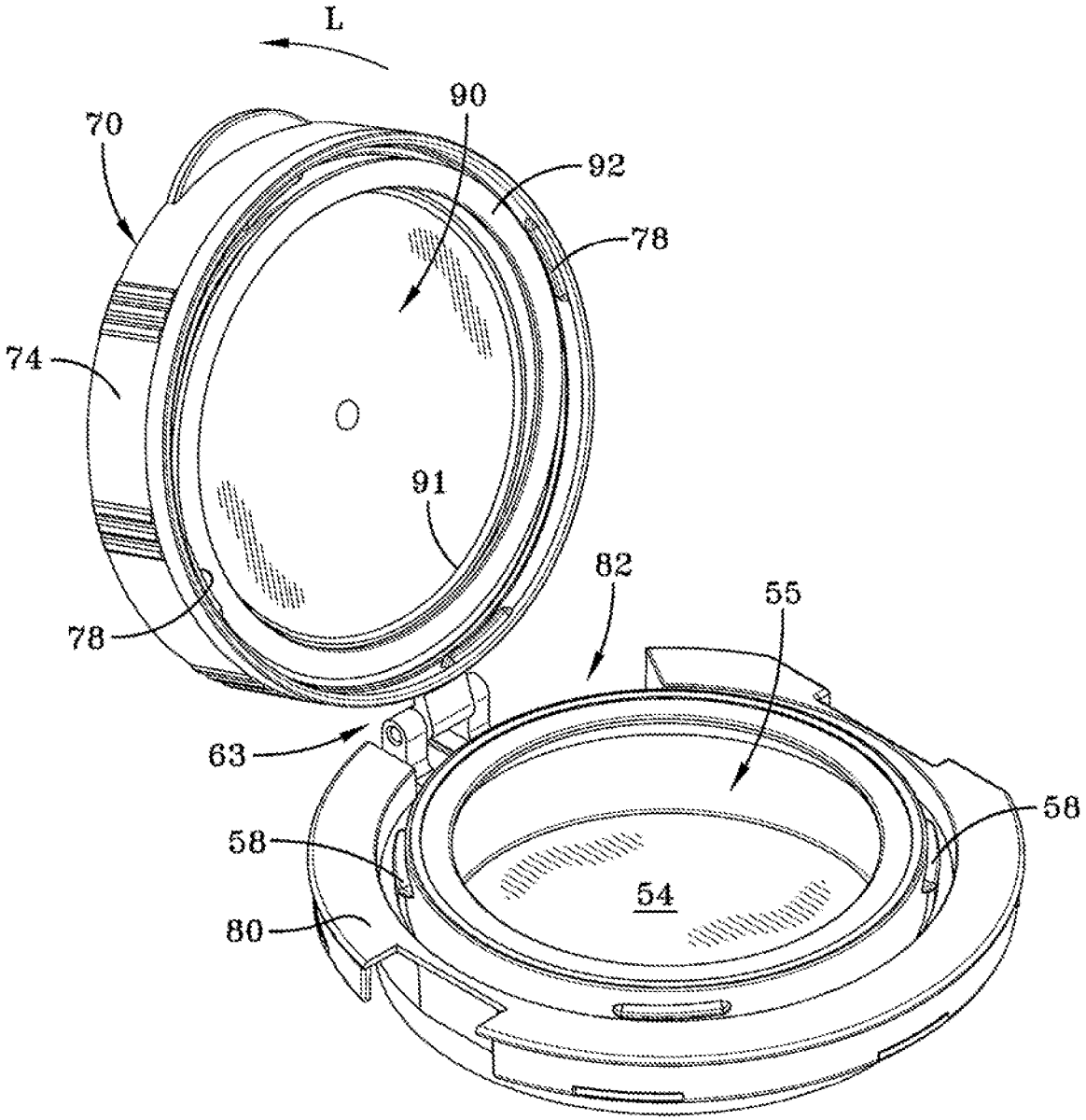
FIG. 11 shows the sealable container of FIG. 10 with the hinged lid lifted to an uncovered, open position.
Figure 12:
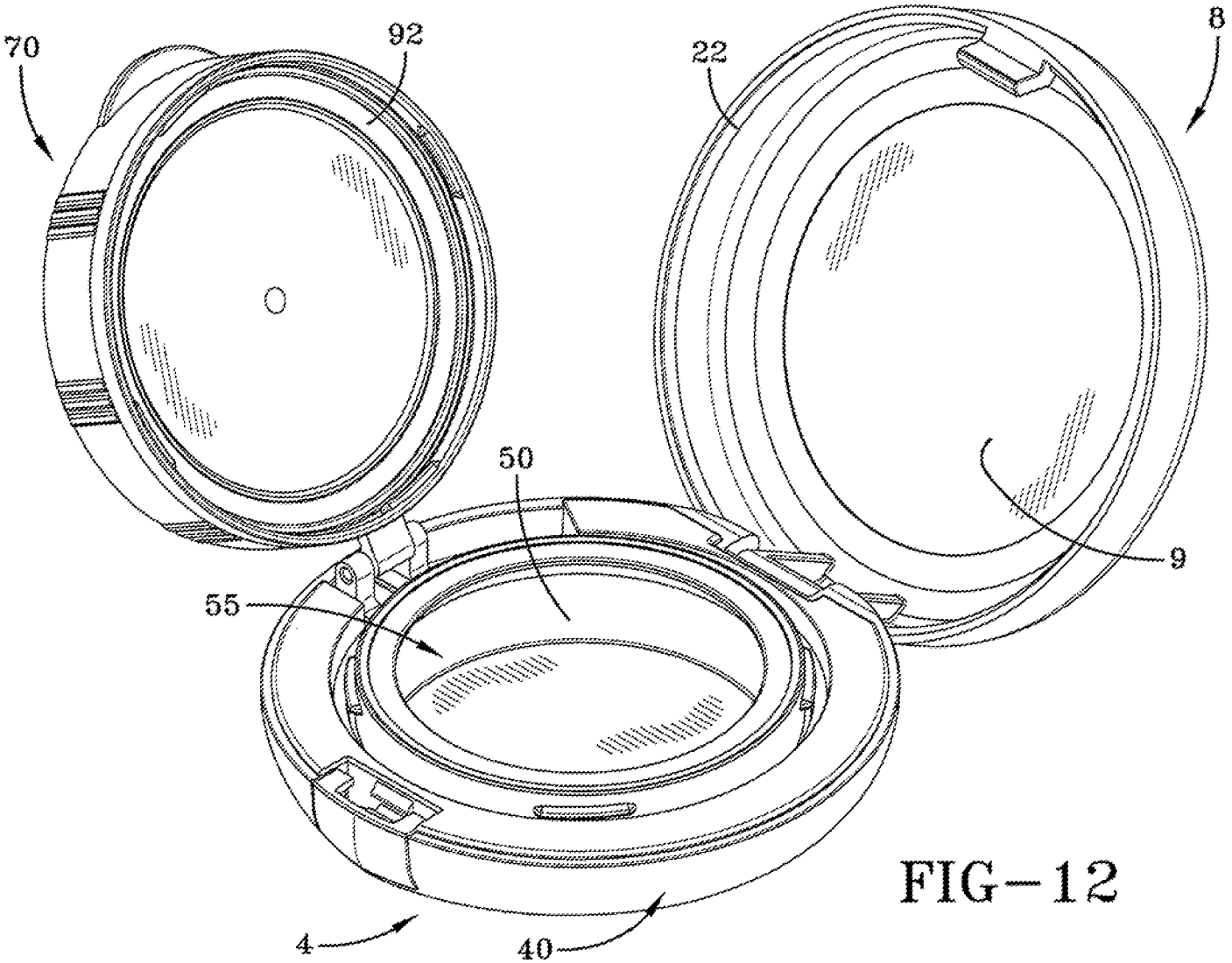
FIG. 12 shows the sealable container of FIG. 11 disposed within the lower base unit of the compact case with the upper cover unit opened.

The hinged ring 60 provides a means for joining the compact cover 70 with the container 50 after the compact cover 70 has been unthreaded from and moved away from the opening of the container 50. As shown in FIGS. 4-6, the hinged ring 60 can be joined to the container 50 by sliding the hinged ring 60 upward from under the container 50, to where the inner rim 69 of the hinged ring 60 engages the side rib 59 of the container 50. In the illustrated embodiment, in one embodiment, the hinged ring 60 is not retained, fixed or secured to the container 50, but when assembled, is held in position axially between the lower base 40 and the container 50, with the container 50 being secured or retainer by the lower base 40. As illustrated, the hinged ring 60 joins the compact cover 70 to the container 50 in a covering position, shown in FIG. 10, and hingedly pivots the compact cover 70 to an uncovered position, shown in FIG. 11, while remaining joined to the container 50. In the uncovered position, the compact cover 70 can pivot away from the opening to the container 50 to permit the user to access the volatile composition within. As shown in FIG. 12, the pivoted-open compact cover 70 does not interfere or engage with the upper cover 22 in its open position.

The wall 62 of the hinged ring 60 has a lower rim 64 and includes an annular inner rim 69 along the lower rim 64 that extends radially inwardly. The inner rim 69 supports the annular side rib 59 of the container 50, as shown in FIGS. 6 and 7. The inner rim 69 provides a lower surface on which the side rib 59 and the container 50 can rotate relative to the inner rim 69 and the hinged ring 60. In the illustrated embodiment, the container 50 is positioned within the hinged ring 60 so that the post 56 is disposed in a gap between a pair of tabs 66*a* and 66*b* that extend radially inwardly from the inner rim 69, which provide rotation stops to limit the angle of rotation of the container 50 within the hinged ring 60. In the illustrated embodiment, the container 50 includes a pair of posts 56, on a direct opposite sides of the container 50, and the hinged ring 60 includes a second pair of the tabs 66*a* and 66*b* directly opposite said first pair of tabs. The pair of tabs 66*a* and 66*b* limit rotation of the compact cover 70, which is rotatable with the hinged ring 60, by blocking rotative movement of the post 56 on the container 50, and specifically, limiting rotation of the compact cover 70 on the container 50 between the first rotated position illustrated in FIG. 8 and the second rotated position illustrated in FIG. 9.

Also illustrated in FIG. 4 is a nub 68 that protrudes radially inwardly from the inner rim 69, and is disposed between the pair of tabs 66*a* and 66*b*, though closer to the tab 66*a* with a space there between. The nub 68 protrudes only a short distance inwardly, to only frictionally interfere with the post 56 as the post 56 and the container 50 are rotated manually by the user either toward or away from the tab 66*a*. The nub 68 sufficiently interferes with the rotative movement of the post 56 to prevent the compact cover 70 from moving incidentally from its first rotated position relative to the container 50, at which the compact cover 70 can be hingedly opened and closed over the opening of the container 50, toward the second rotated position.

As noted above, when the sealable container 6 is inserted down into the opening of the annular frame 42 of the lower base 50, the annular side rib 59 of the container 50 engages and is supported on the upper edge 43 of the frame 42 of the lower base 40. Concurrently, the side rib 59 of the container 50 is also being supported on the inner rib 69 of the hinged ring 60, where the frame 42 will be disposed radially between the lower wall 52 of the container 50 and the inner rib 69 of the hinged ring 60, and the lower rim 64 of the wall 62 of hinged ring 60 is disposed within and can rotate within the annular track 44 of the lower base 40.

Figure 13:
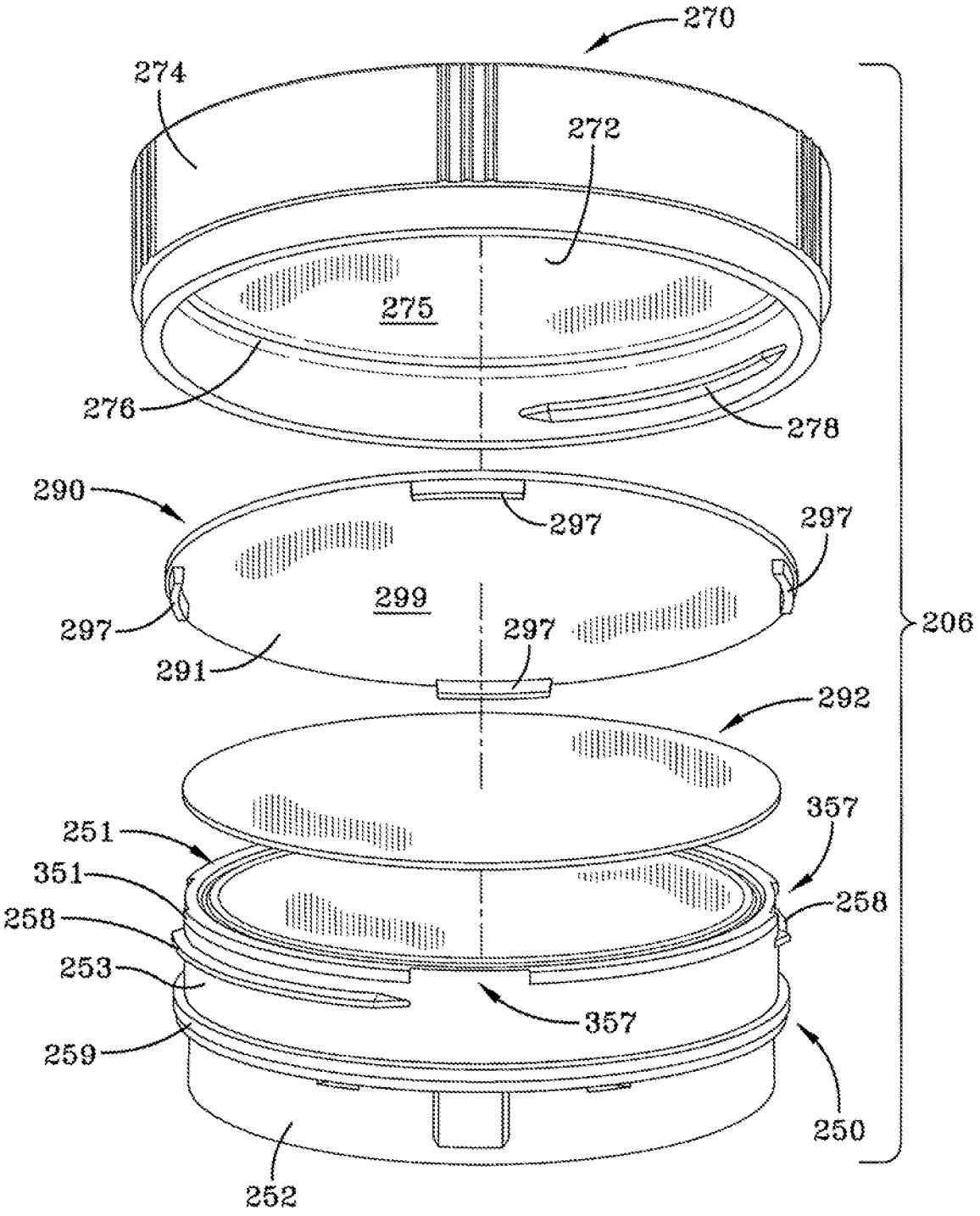
FIG. 13 shows an exploded view of a second embodiment of a replaceable sealable container for a volatile composition.
Figure 14:
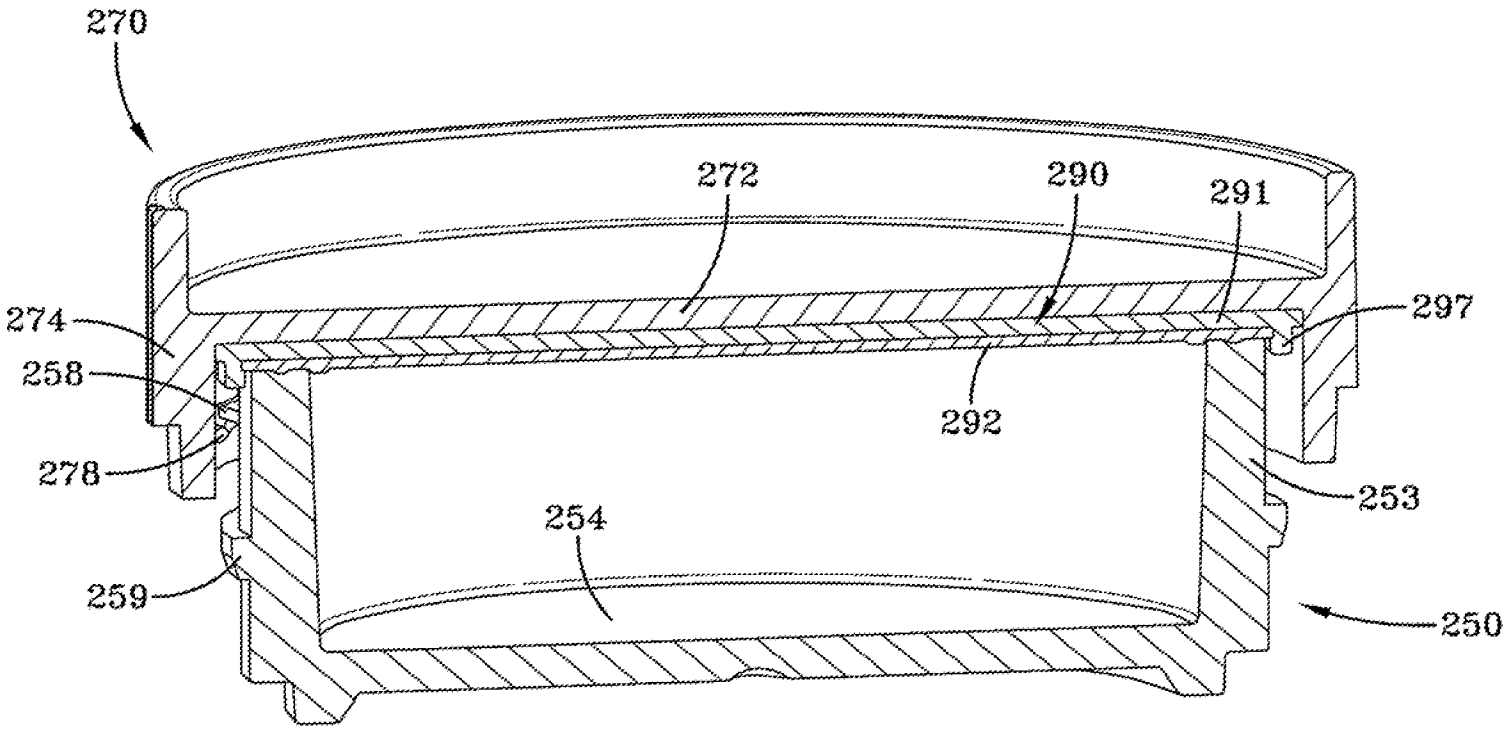
FIG. 14 shows a sectional view of the second embodiment of the sealable container viewed through line 14-14 of FIG. 15.
Figure 15:
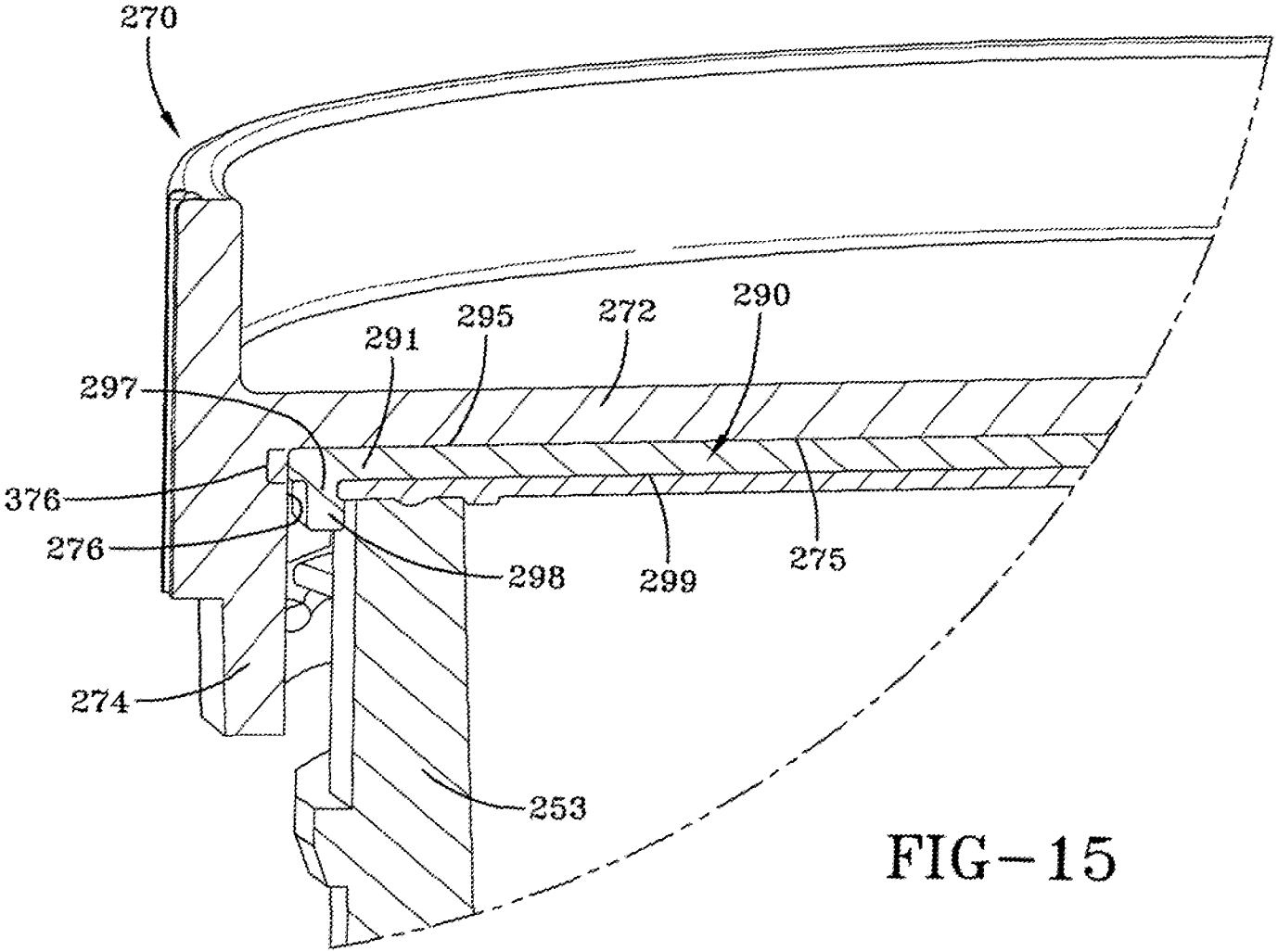
FIG. 15 shows a detailed view of a seal member illustrated in FIG. 14.
Figure 16:
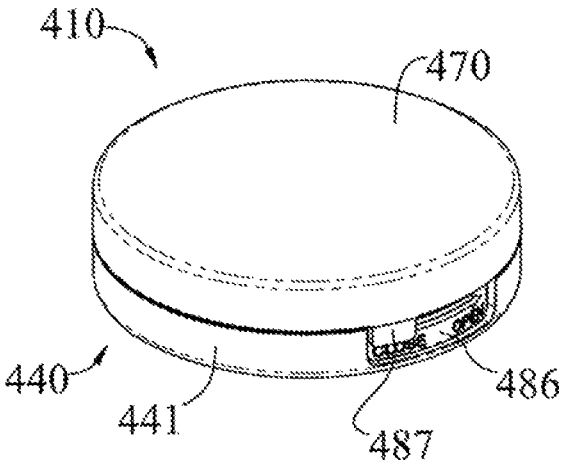
FIG. 16 shows a top-front perspective view of another embodiment of a compact case according to the invention.
Figure 17:
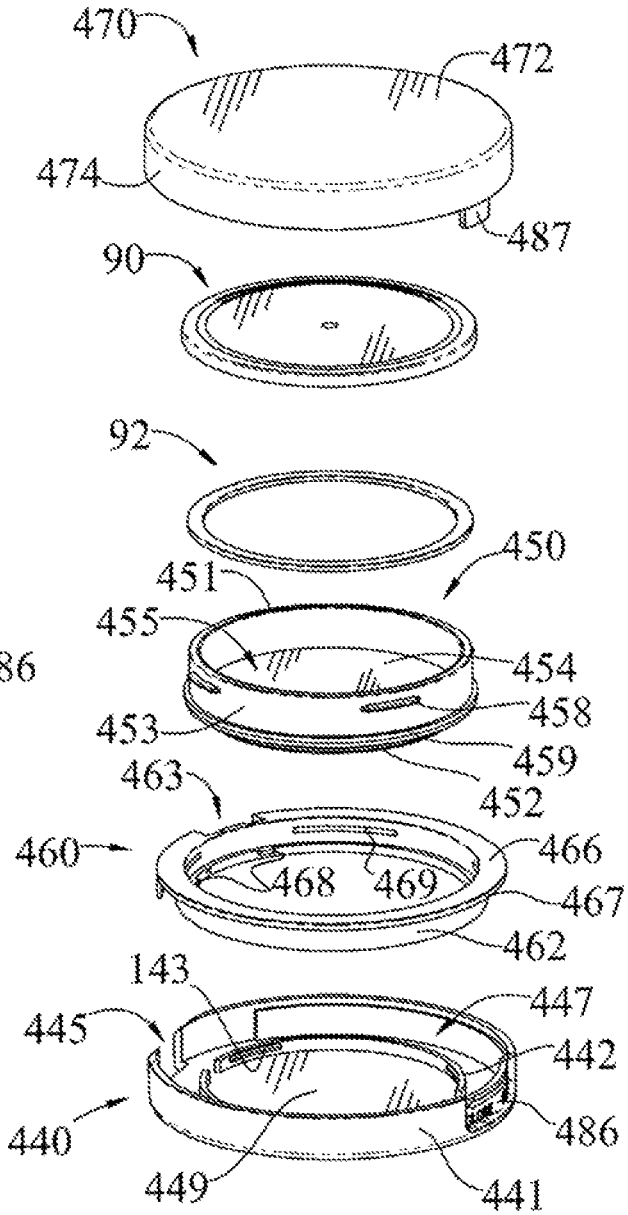
FIG. 17 shows an exploded view of the components of the compact case of FIG. 16.
Figure 18:
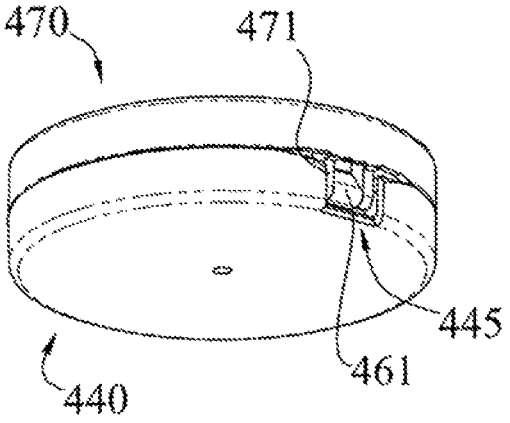
FIG. 18 shows a bottom-rear perspective view of the compact case shown in FIG. 16.

FIG. 13-15 illustrate a second embodiment of a replaceable sealable container for a volatile composition. The second embodiment of the sealed container 206 is configured to be replaceable within a compact unit, by insertion and removal from a lower base unit, and to be covered over with an upper cover unit to form a case, as described above in the first embodiment.

The sealed container 206 includes a component container 250 including an annular wall and a bottom, the annular wall including a lower wall 252, an upper wall 253, and annular rib 259 that extends from and separates the lower wall 252 and the upper wall 253. The upper wall 253 includes at least a pair of outwardly-extending thread segments 258 distributed evenly around the circumference of the outside surface of the wall. Each of the thread segments 258 align along a helical or slanted path. The container 250 also has a circular upper rim 251 that defines a surface to be closed and sealed by the compact cover 270. The upper rim 251 includes an outer flange 351 that has a plurality of slots 357 along the outside circumference of the flange 351, described further below.

The compact cover or lid 270 is configured to be threadedly secured to the top opening of the container 250 to seal the upper rim 251, substantially as described for the first embodiment. The compact cover 270 includes a cover plate 272 with an inside surface 275 and an outer surface, and an annular wall 274. The annular wall 274 extends downward from the periphery of the cover plate 272. The wall 274 includes at least a pair of inwardly-extending thread segments 278 distributed around the circumference. Each of the thread segments 278 align along a helical or slanted path, to engage thread segments 258 of the container 250 for threadedly sealing the container, as described for the first embodiment. The compact cover 270 also includes an annular inner rib 276 that extends a minimal distance radially inwardly from the inner surface of the wall 274, and a fixed axial distance from the inside surface 275 of the cover plate 272 to define a groove 376 there between, as shown in FIG. 15.

The sealed container 206 comprises a seal system that includes an annular seal disposed between the upper rim 251 of the container 250 and the inside surface 275 of the cover plate 272. The annular seal includes an alternative means for preventing rotative forces comprising a seal plate 290 having an outer periphery 291, and a seat seal ring 292 that registers at least with the outer periphery 291 of a seal plate 290. The seal plate 290 is a circular disk, typically made of a resilient thermoplastic material, and the outer periphery 291 of the seal plate 290 is retained within the groove 376 of the compact cover 270 by the annular inner rib 276, so that the seal plate 290 remains with the compact cover 270 during product use. The seal plate 290 also includes a plurality of downwardly projecting segments 297 around the periphery. The projecting segments 297 include an inwardly-projecting ledge 298 (FIG. 14) that offset a distance axially from the under surface 299 of the seal plate 290 of about the thickness of the seat seal ring 292. In an embodiment, the peripheral edge of the seat seal ring 292 is retained by the plurality of ledges 298 (FIG. 15).

It can be understood that the second embodiment of the sealable container can comprise the seal system and/or means for preventing rotative force described above for the first embodiment and illustrated in FIGS. 7A and 7B.

When the compact cover 270 is placed over the container 250, the projecting segments 297 of the seal plate 290 align with and bayonet into a plurality of slots 357 along the circumference of the outer flange 351 of the container 250, to rotatively lock the seal plate 290 in position over the upper rim 251 of the container 250. As the compact cover 270 is rotated to threadedly draw the inside surface 275 of the plate 272 onto the upper rim 251 of the container, the seal plate 290 remains stationary, held in place against rotation by the projecting segments 297 disposed in the slots 357. While the inside surface 275 of the compact cover 270 slides rotatively over the stationary upper surface 295 of the upper seat seal member 290, the material of the seat seal ring 292, disposed against the upper rim 251 of the container 250, is protected from circumferential shear forces, and is prevented from tearing, bunching and deforming.

In the illustrated embodiment, the seal plate 290 is a circular disk, though in an alternative embodiment can be an annular ring, and is typically made of a resilient thermoplastic material, preferably having low vapor diffusivity.

FIGS. 16 through 19 show various views and components of another embodiment of a compact case according to the invention.

The base 440 is illustrated with a dish shape having an open top end 447, and includes a short cylindrical outer wall 441 extending from a circular base floor 449. The outer wall 441 has an arcuate portion thereof removed to define a hinge window 445, which extends from near the base floor 449 to the upper edge of the wall 441. In the illustrated embodiment, the hinge window 445 has a rectangular shape, though could be curved or arcuate, provided that the hinge window 445 meets its functional feature of allowing the hinged cover to pivot open, as hereinafter described.

Figure 20:
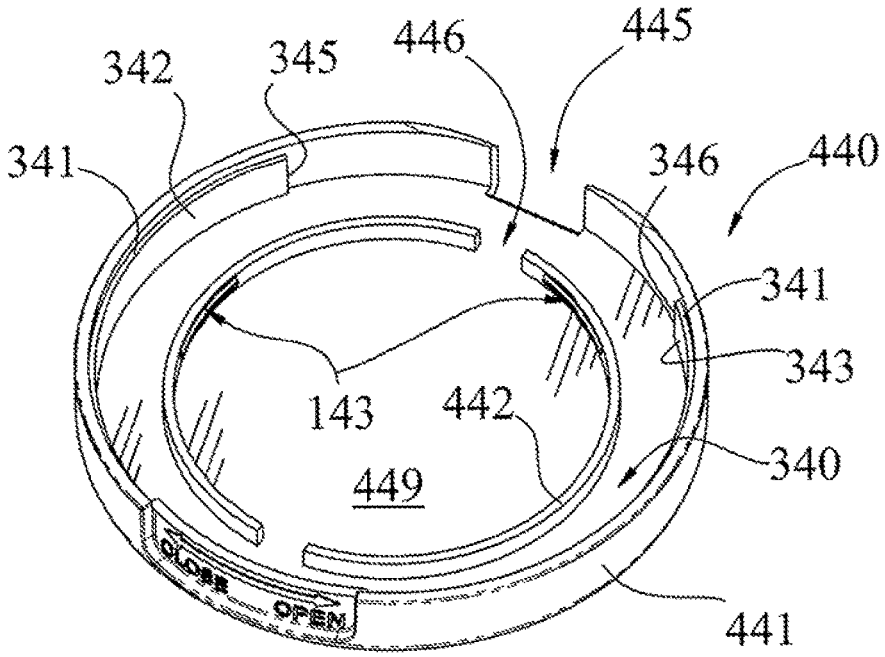
FIG. 20 shows a top perspective view of a base of the compact case of FIG. 17.
Figure 21:
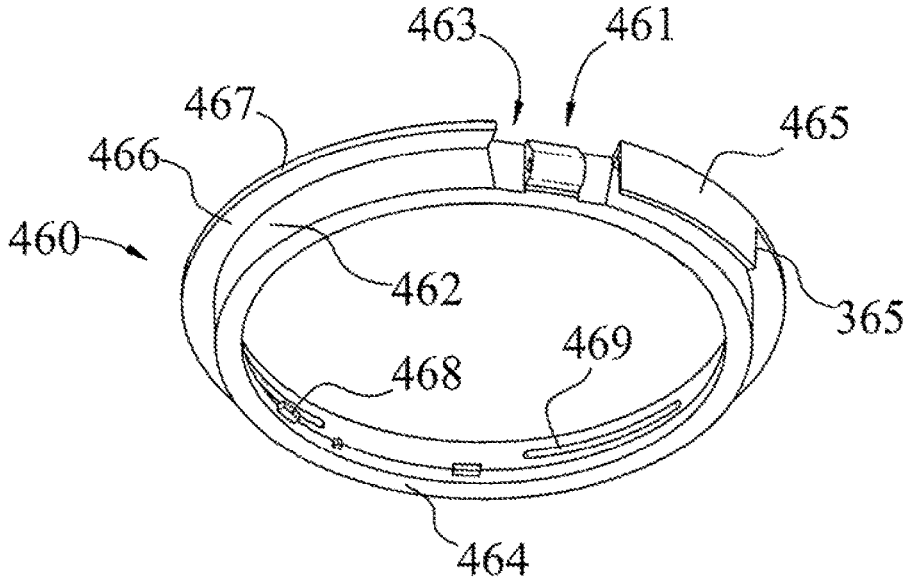
FIG. 21 shows a bottom perspective view of a hinge ring of the compact case of FIG. 19.
Figure 22A:
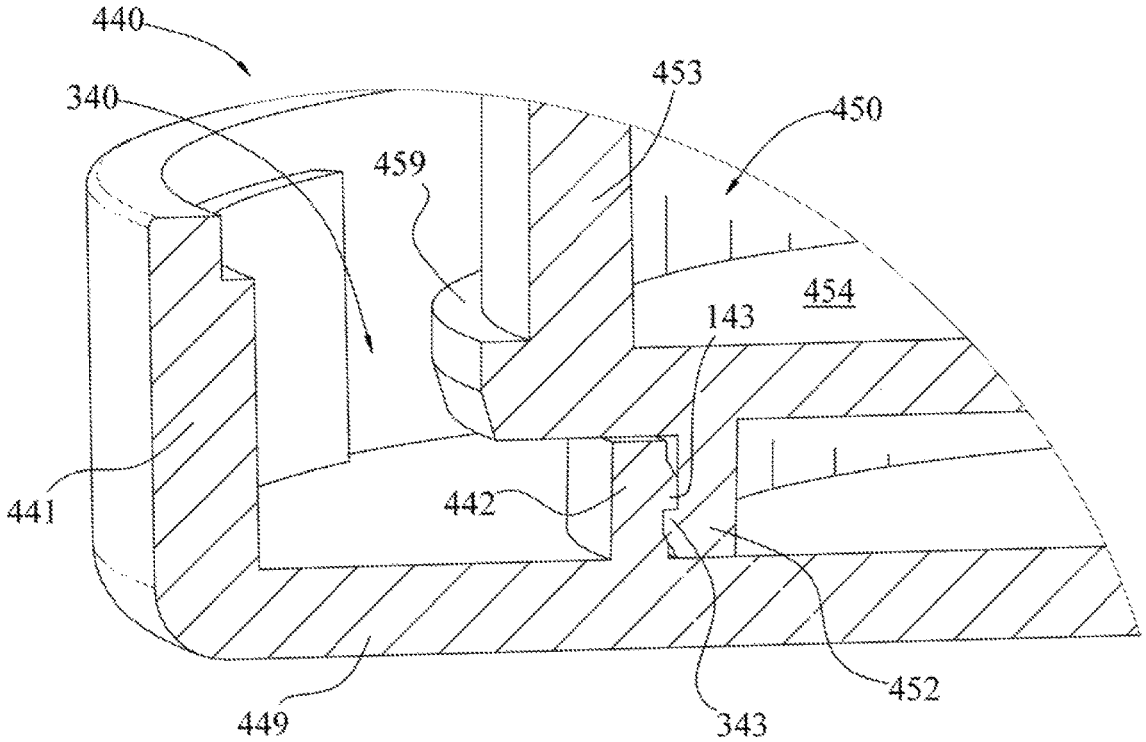
FIG. 22A shows a sectional view of a base and container assembly of FIG. 24.

The base 440 further includes a pair of opposed, arcuate support walls 342 and 343, shown in FIG. 20, disposed along the inner surfaces of the outer wall 441. The support walls 342 and 343 include an upper support ledge 341. Support wall 342 includes an end stop 345, and support wall 343 includes an end stop 346, each end stop disposed nearest the hinge window 445. The base 440 also includes a circular frame wall 442 extending axially from an upper surface of the base floor 449 that provides a frame for installing the container 450, and a means for securing the installed container 450 to the base 440. The securing means includes a plurality of an inwardly extending catch 143 at the upper edge of the frame wall 442, illustrated in FIG. 22 and described later.

The container 450 is substantially as described herein above in another embodiment as container 50. The container 450 includes an outer wall 453 with thread segments 458 and an upper rim 451, which defines a top opening into a container space 455, and a closed bottom or floor 454. The bottom 454 extends radially beyond the outer wall 453 to provide an annular rib 459. The container 450 also includes a circular lower wall 452 that extends from the under surface of the bottom 454. The lower wall 452 is configured to register within the frame wall 442 of the base 440, for positioning and alignment of the container 450 within the compact case. The container 450 is securable in a fixed position onto a base floor 449 of the base 440, illustrated in FIG. 22 and described later, and extends through the upper opening 447 of the base 440.

Figure 24:
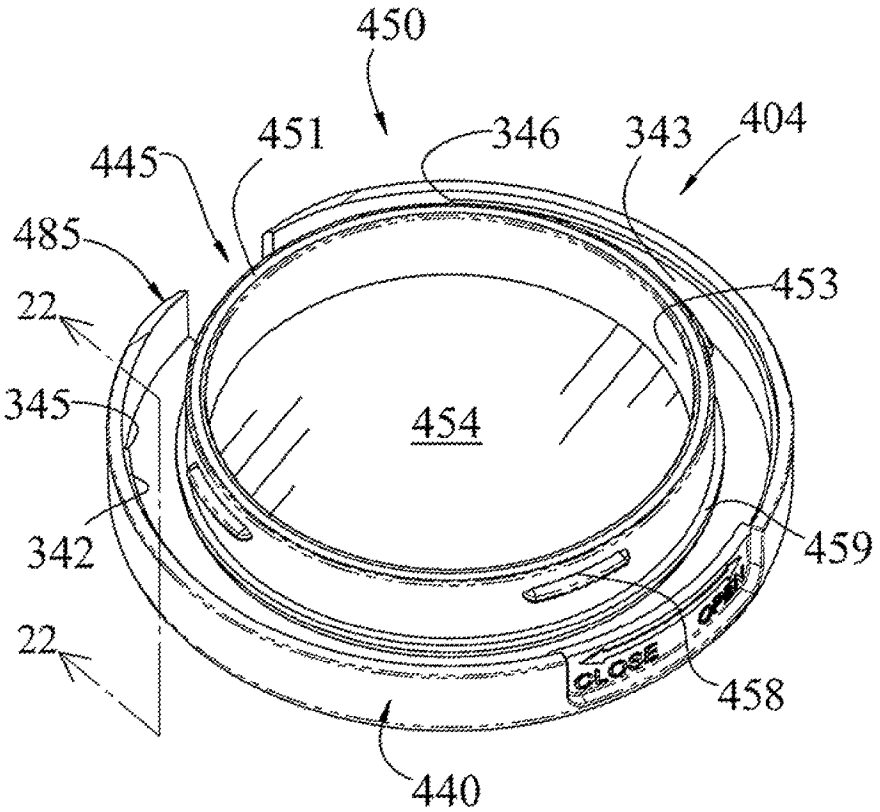
FIG. 24 shows a top view of an assembly of the container and base of FIG. 23.
Figure 23:
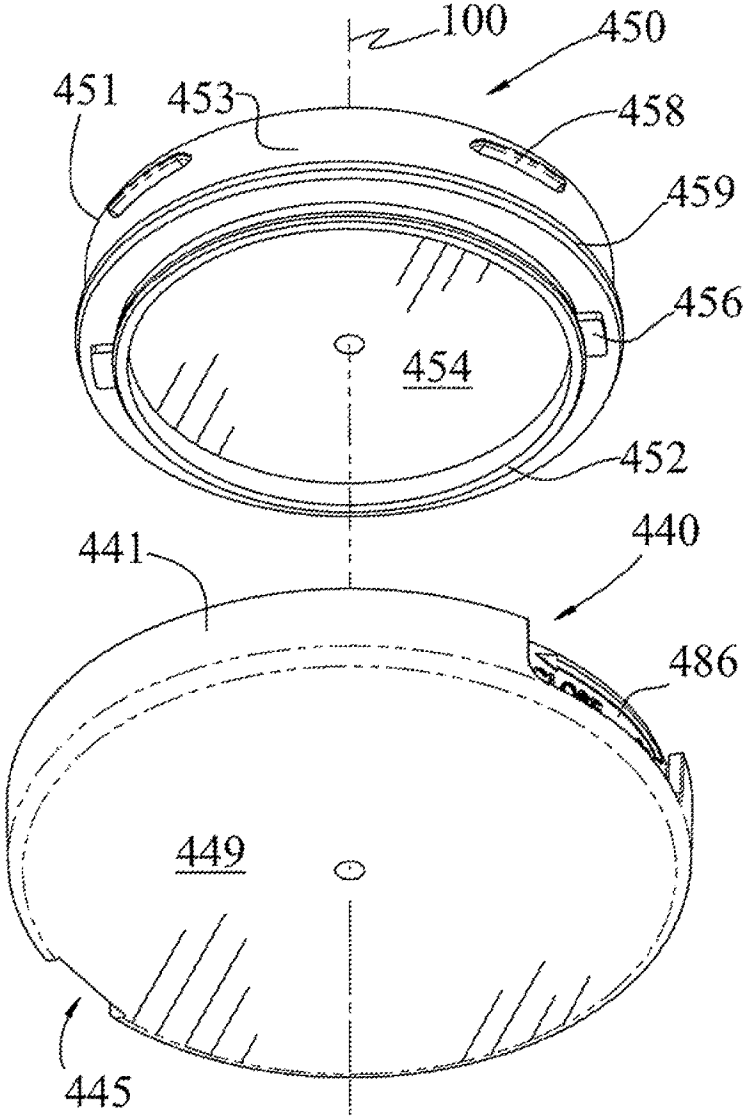
FIG. 23 shows a bottom perspective view of a base and a container of FIG. 19, with the container aligned with the base of FIG. 16.

In an embodiment of the invention shown in FIGS. 23-24, the container 450 and base 440 can be assembled into a container assembly 404. When assembled and secured as the container assembly 404, the container 450 is secured or locked to the base 440 to prevent relative rotation about the centerline 100. The container 450 and base 440 include a rotation prevention lock, which includes a pair of posts 456 positioned on the under surface of the bottom 454, extending radially outward from the lower wall 452 (FIGS. 19 and 23), that align with and register in a pair of opposed slots 446 formed into the frame wall 442 (FIG. 20), to prevent axial rotation of the container 450 while retained in the base 440. When a user grasps and holds the base 440 of the compact case 410, the rotation prevention lock prevents any rotation of the container 450 by a rotative force, such as when the cover 470 is rotated to unseal and remove the cover 470 from the container 450.

To secure the container 450 to the base 440, the frame wall 442 of the base 440 includes a plurality of inwardly extending catches 143 that engage an oppositely-oriented annular catch 443 (FIG. 22A) that extends radially outwardly from the lower edge of the lower wall 452 of the container 450. The illustrated embodiment includes three segments of inwardly extending catches 143, spaced equally around the periphery of the frame wall 442, each of the three catches 143 extending in a circumferential arc of about 30 degrees, along the periphery. The limited circumferential engagement of the oppositely-oriented catches 143 and 443 is sufficient to maintain securement of the container 450 with the base 440 during ordinary storage and use. The use of an extra force by the user can be used to pry the container 450 from its securement with the base 440, such as when a container of cosmetic product has been used up, and the used-up container 450 needs to be removed to insert a fresh container 450.

The annular hinge ring 460 of the compact case includes an annular inner wall 462 having an upper edge and a lower edge, an annular ledge 464 extending inwardly and radially from the lower edge, and an annular platform 466 extending radially outward from the upper edge to an outer periphery 467. The hinge ring 460 also includes a hinge member 461 extending radially outward from a portion of the inner wall 462, and a veil wall 465 that extends downward axially from a portion of the outer periphery adjacent the hinge member 461. The veil wall 465 has an arc shape corresponding to the curvature of the periphery 467, and extends down axially a height substantially the same height of the inner wall 462. A portion 463 of the platform 466 is removed to avoid interfering with the hinge 471 of the cover 470 when pivoted open, as described below.

The hinge ring 460, in an assembled form, is configured to fit down into the base 440, with the outer periphery 467 of the hinge ring 460 extending to the inside of the outer wall 441 of the base 440, and to rest upon the ledges 341 of the support walls 342 and 343. The inner wall 462 of the hinge ring 460 extends down into a channel 340 of the base 440 between the outer wall 441 and the frame wall 442. Within the channel 340, the hinge ring 460 has limited rotation around the container 450, between a closed position and an openable position, as described below.

The cover 470 includes a cover plate 472 and an annular wall 474 extending from the periphery of the cover plate 472 to form a closed end, and a hinge member 471 extending from a portion of the annular wall 474. The cover 470 also includes thread segments 478 on an inside surface of the outer wall 474, configured to engage with the threads 458 on the outside surface of the wall 453 of the container, as described below.

Figure 19:
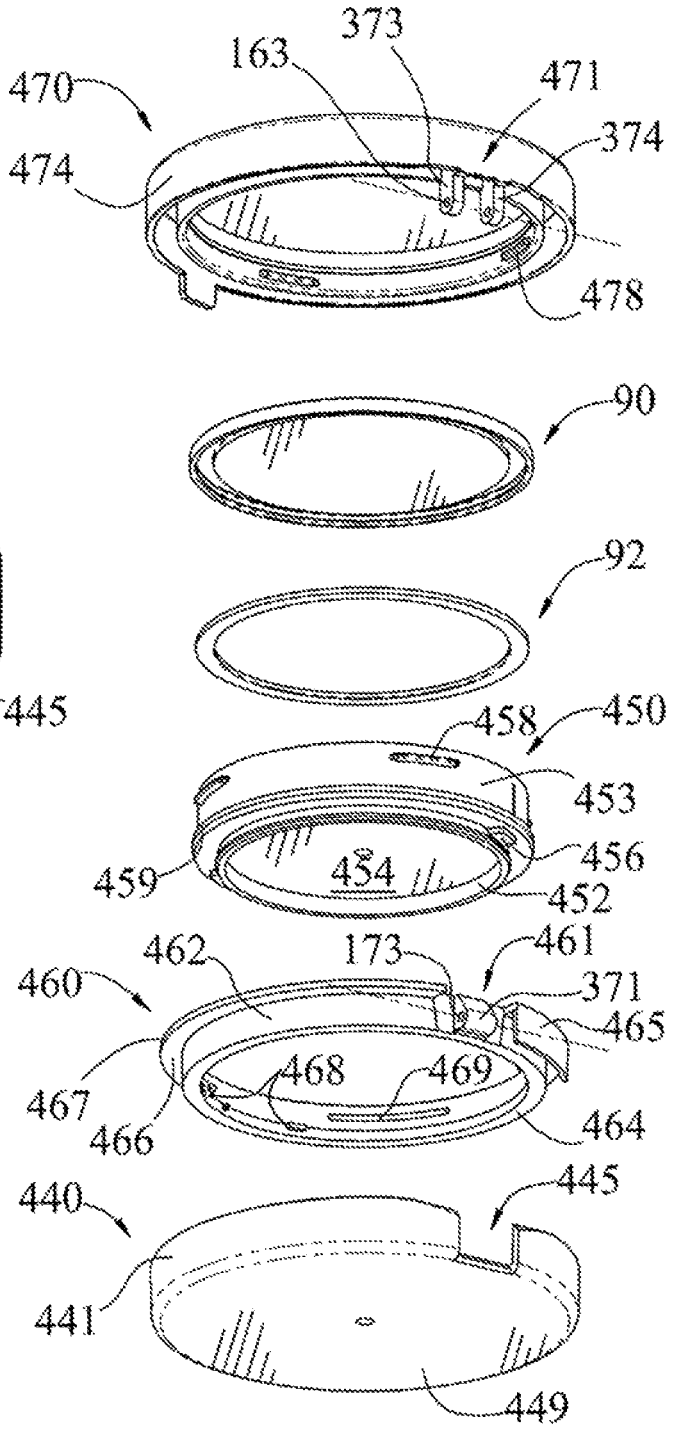
FIG. 19 shows an exploded view of the components of the compact case of FIG. 18.
Figure 26:
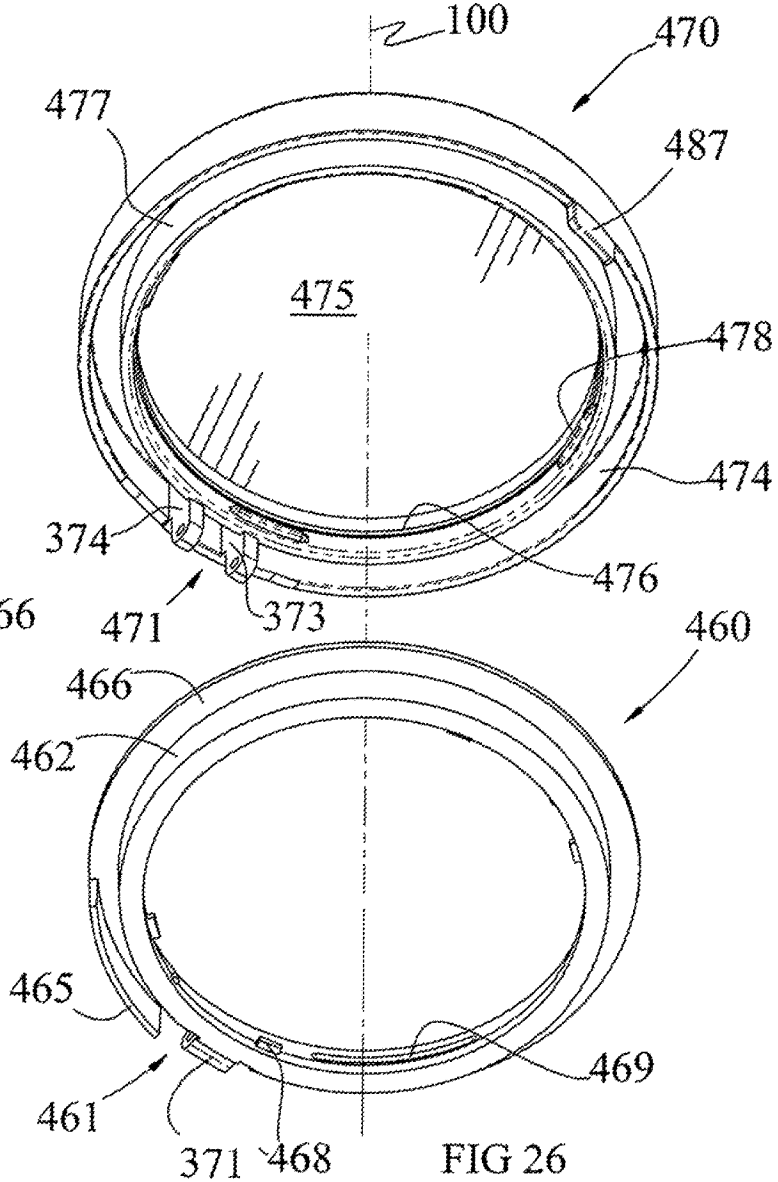
FIG. 26 shows an exploded view of the cover and hinge ring assembly of FIG. 25.
Figure 25:
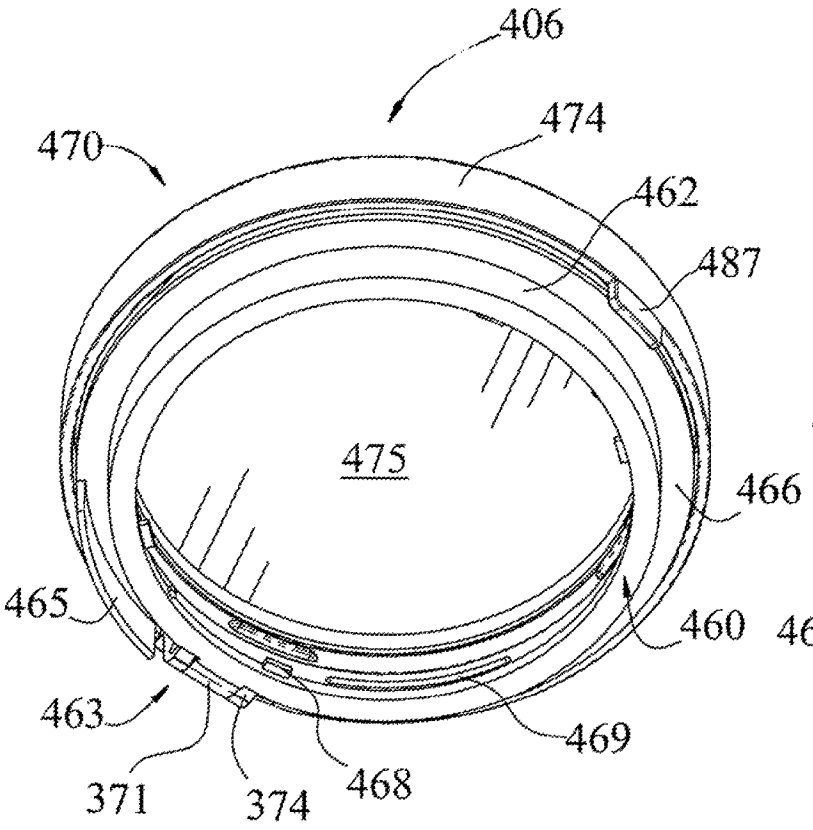
FIG. 25 shows a bottom perspective view of a cover and a hinge ring of FIG. 19, where the cover assembled and hinged with the hinge ring.
Figure 28:
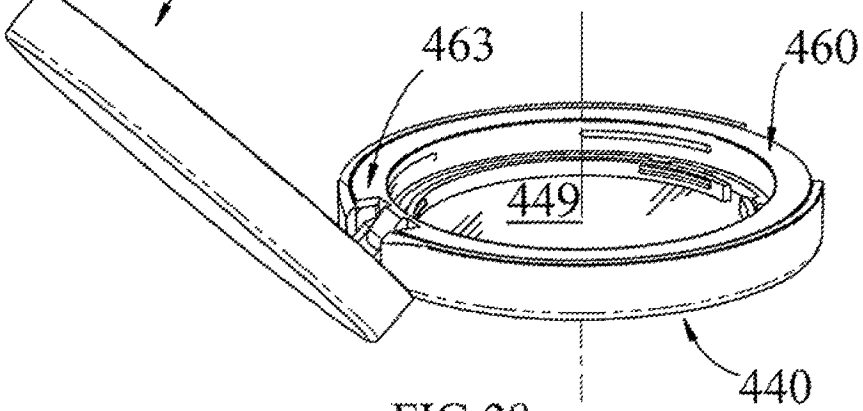
FIG. 28 shows the cover and hinge ring assembly of FIG. 27 assembled with the base.
Figure 27:
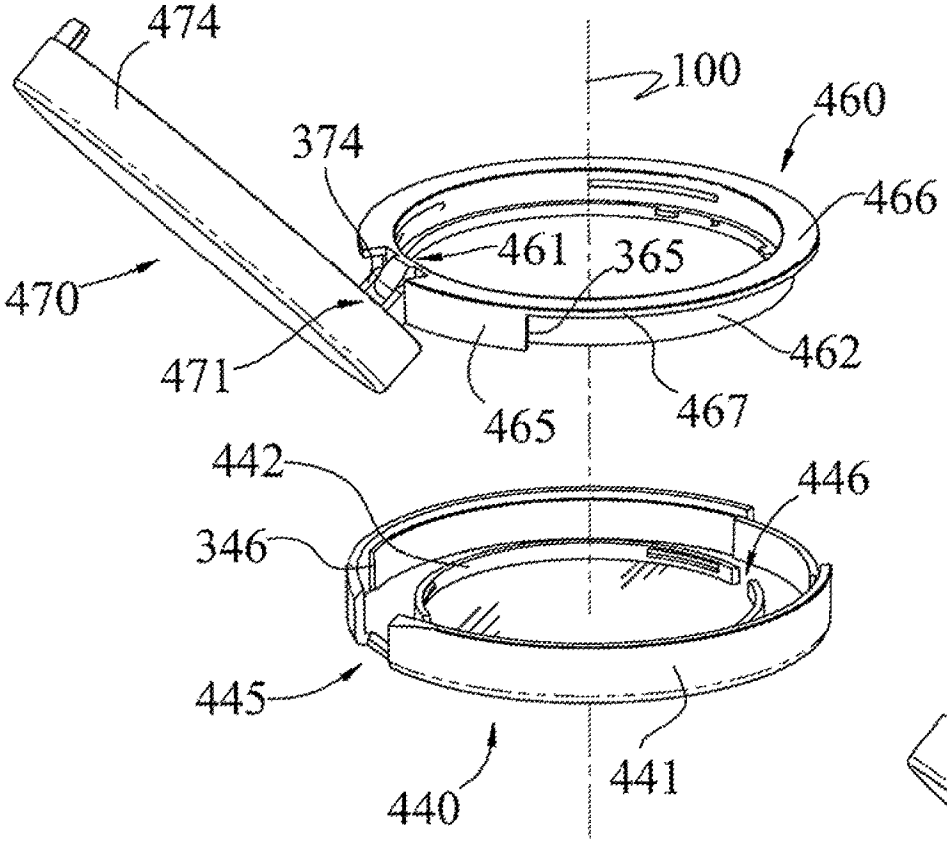
FIG. 27 shows the cover and hinge ring assembly of FIG. 26, with the cover pivoted to an open position, and aligned over the base.
Figure 29:
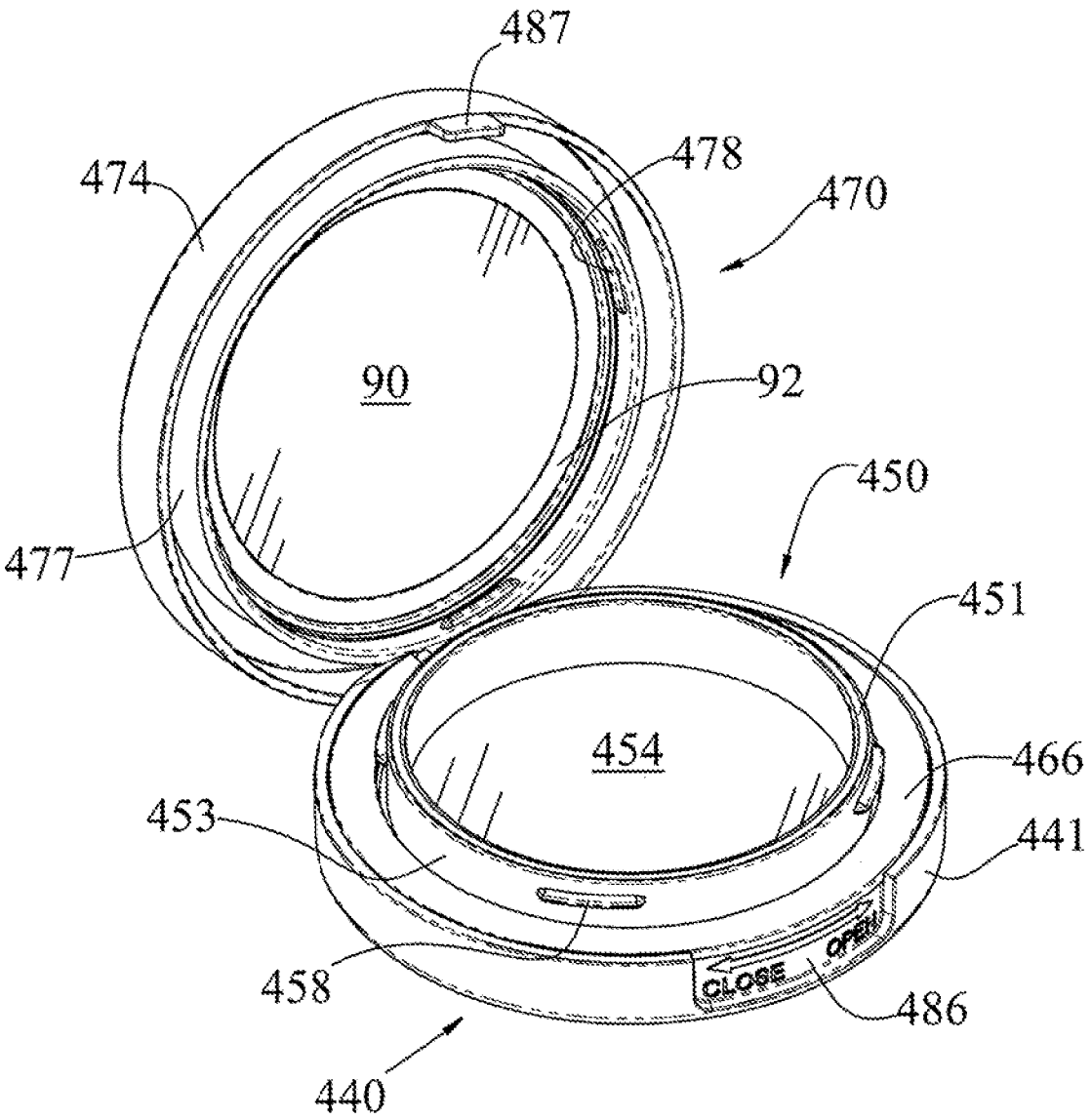
FIG. 29 shows the assembly of FIG. 28 with a container installed onto the base.
Figure 30:
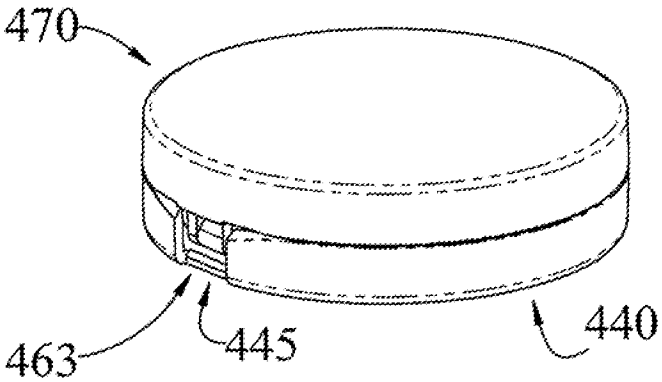
FIG. 30 shows the assembled compact case with the cover pivoted to the covered position.
Figure 31:
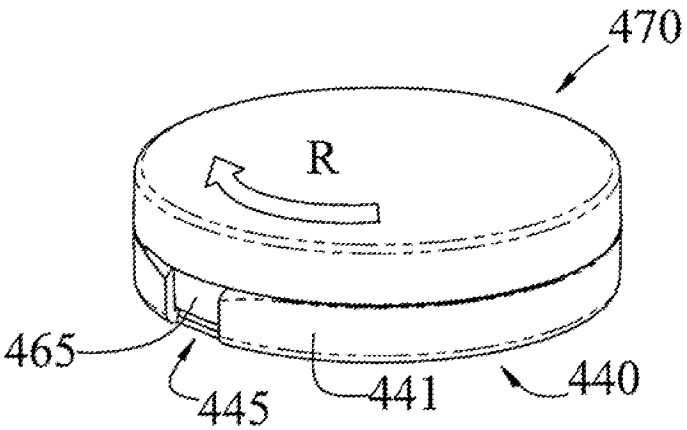
FIG. 31 shows the assembled compact case with the cover rotated to the closed and sealed position.

In a further embodiment, as shown in FIGS. 19, 25 and 26, the cover 470 and the hinge ring 460 can comprise a hinged cover assembly 406. The hinge member 471 of the cover 470 includes a pair of laterally spaced-apart support lugs 373 and 374 with a lateral bore 163 formed through each support lug 373,374. The hinge member 461 of the hinge cover 460 comprises a widened support lug 371 with a lateral bore 173 formed through the widened support lug 371. As shown in FIGS. 25 and 26, when the cover 470 is assembled with the hinge cover 460, the support lug 373,374 are secured around the support lug 371 with a pin (not shown) to form a hinge 463. The hinge 463 joins the cover 470 with the hinge ring 460 into rotational unitary assembly 406, such that when a user applies rotation to the cover 470, the hinge ring 460 rotates with the cover 470. The hinge 463 provides a means for pivoting the cover 470 between an uncovered position, as shown in FIGS. 28 and 29, and a covering position, as shown in FIG. 30. At both the uncovered position and covering positions, the cover 470 and the hinge ring 460 are both at a rotatively openable position relative to the container 450 and the base 440, at which the hinge 463 is registered with the hinge window 465 of the base 440, as seen in FIG. 30. From the rotatively openable position, with the cover in the covering position, the thread segments 478 are out of engagement with the container's threads 458. The user can rotate the cover 470, clockwise in the illustrated embodiment, to the closed position shown in FIG. 31, where the veil wall 465 registers with the hinge window 445 of the base 440. When the cover 470 is rotated from the openable position to the closed position, the thread segments 478 of the cover engage with the thread segments 458 of the container, to threadedly draw the cover plate 472 axially down toward the upper rim 451 of the container, and to the sealing position.

In a further embodiment, the veil wall 465 is disposed circumferentially adjacent to the hinge member 461 of the hinge ring 461, displaced an arc angle of about 10-40 degrees.

Figure 22B:
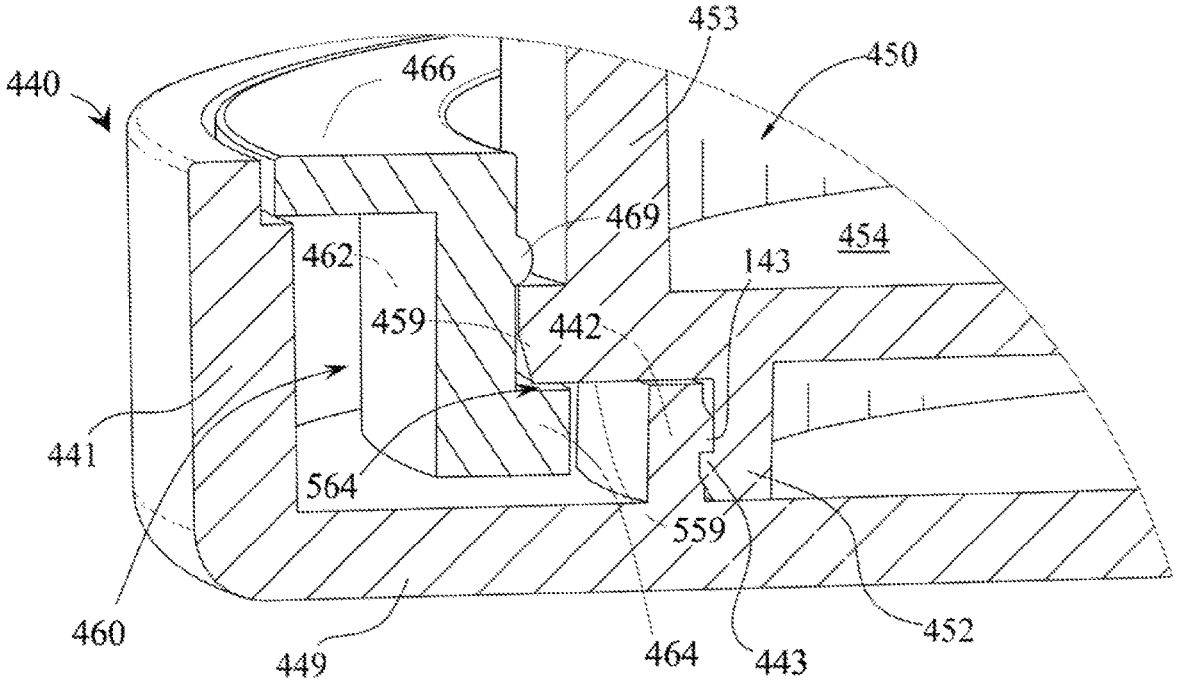
FIG. 22B shows a sectional view of a base and container assembly of FIG. 24, with the hinge ring of FIG. 21.

In another embodiment, the compact case includes the container assembly 404 and the hinged cover assembly 406, described above, that is retained to and rotatable about a central axis relative to the container assembly 404. The compact case can be assembled as shown in FIGS. 25-31. The hinged cover assembly 406 is prepared by pinning the hinge members 471 of the cover and hinge member 461 of the hinge ring (FIG. 25) to form the hinge 463 of the hinged cover assembly (FIG. 24). The hinged cover assembly 406 is opened, and the hinge ring 460 is aligned with the centerline 100 and registered with the base 440 so that the hinge 463 registers with the hinge window 445 (FIG. 27), and then pressed down into the base 440 (FIG. 28). The container 450 can then be pressed down into the frame wall of the base 440 to complete the assembly (FIG. 29). As shown in FIG. 22B, the hinge ring 460 sits into the channel 340 of the base 440 retained by the hinge ring 460, with the annular rib 459 of the container 450 retained between the annular ledge 464 and an inner-facing rib 469 of the hinge ring 460. In a preferred embodiment, a gap 564 is maintained between the upper surface of the annular ledge 464 of the hinge ring 460 and the under surface 559 of the annular rib 459 of the container 450, to minimize or prevent binding of the cover 470 when pivoted into a closed position onto the container 450, as described herein above.

Rotation of the hinge ring 460, from a rotative openable position to a closed position, is limited by the circumferential contact of the hinge 463, and specifically the hinge support lug 373, with the end 346 of the second support wall 343 of the base 440. In the rotative closed position, the veil wall 465 of the hinge ring 460 registers with the hinge window 445. Rotation of the hinge ring 460 from the closed position to the openable position is limited by the circumferential contact of the edge 365 (FIG. 27) of the veil wall 465, with the end 345 of the first support wall 342 of the base 440 (FIGS. 20 and 24). In the rotated openable position, the hinge 463 of the hinged cover assembly 406 registers with the hinge window 445.

In the illustrated embodiment, the container 450 is positioned within the hinged ring 460 so that the post 456 is disposed in a gap between a pair of spaced-apart tabs 468 (see FIGS. 17 and 19) that extend radially inwardly from the inner rim 464, which provide rotation stops to limit the angle of rotation of the container 450 within the hinged ring 460. In the illustrated embodiment, the container 450 includes a pair of posts 456, on a direct opposite sides of the container 450, and the hinged ring 460 includes a second pair of the spaced-apart tabs 468 directly opposite the first pair of tabs. The pair of tabs 468 limit rotation of the compact cover 470, which is rotatable with the hinged ring 460, by blocking rotative movement of the post 456 on the container 450, and specifically, limiting rotation of the compact cover 470 on the container 450 between the first rotated position illustrated in FIG. 16 and the second rotated position illustrated in FIG. 29.

In one embodiment, the base 440 includes an indicator frame 486 formed into an outer surface of the outer wall 441, generally opposite the hinge window 445. The indicator frame 486 occupies a circumferential arc portion of the outer wall 441, of about 20-40 arc degrees, and includes an indicium of "Closed" on one side, and "Open" on the opposite side. The cover 470 includes a tab 487 that extends downward from the edge of the wall 474. The circumferential positioning of the tab 487 is configured to overlap the "Closed" indicia when the cover 470 is in the rotative closed position over the base, and to overlap the "Open" indicia when the cover 470 is in the rotative openable position.

In another embodiment of the invention, the sealable container 450 is replaceable, including insertable into and removable from the base 440 of the compact case 410.

In another embodiment, to accommodate the pivoting of the cover 470 to the uncovered position away from the container 450, an upper, outer portion 485 of the outer wall 441 (FIG. 24) on both sides of the hinge window 445, are formed by molding or removed by machining, to make room for the outer wall 474 of the cover 470, adjacent to the hinge 471, to pivot over and outside the upper edge of the outer wall 441.

The components of the sealable container and compact case can be manufactured using well-known and conventional methods, including injection molding and stamping.

We claim:

1. A sealable container for a volatile composition, including:

i) a container including an annular outer wall, and a floor that define a container space for a volatile composition, and the outer wall having an upper rim, an outer surface and including a series of outwardly-extending thread segments;

ii) a compact cover including a cover plate and an annular wall having an inner surface and including a series of inwardly-extending thread segments, the compact cover having a first rotated position relative to the container at which the thread segments of the compact cover are not engaged with the thread segments of the container, and a second rotated position at which the thread segments of the compact cover are engaged with the thread segments of the container to threaded draw the cover plate axially toward the upper rim of the container to a sealing position; and iii) an annular seal disposed between the upper rim of the container and the cover plate of the compact cover, for forming a sealable container for the volatile composition when the compact cover is threadedly drawn over the container to the sealing position, the annular seal including a seal plate having an upper surface and a lower surface having an outer periphery, and a seat seal ring that registers within the outer periphery of the lower surface of the seal plate, and configured to engage the upper rim of the container in the covering position of the compact cover, the seal plate including a means for preventing rotative force applied to the upper surface of the seal plate when rotating the compact cover to the second rotated position, to be exerted to the seat seal ring.

2. The sealable container according to claim 1, further including a hinged ring comprising an annular wall having a lower rim, and a hinge support extending from a portion of said annular wall, and the hinged ring is configured to rotate relative to the container; and the compact cover further includes a hinge member that extends from a portion of the annular wall of the hinged ring to hingedly engage the hinge support of the hinged ring, to pivot the compact cover between an uncovered position and a covering position, and wherein at the covering position the compact cover is disposed in the first rotated position relative to the container.

3. A compact device having a sealable container according to claim 1, further including a lower base having an annular frame and an annular track concentric with and surrounding the annular frame, wherein:

the container further includes an annular rib extending from the outer surface of the outer wall, and the container is securable within the annular frame of the lower base; and the lower rim of the annular wall of the hinged ring is configured for rotation within the annular track of the lower base.

4. The sealable container according to claim 1, wherein the means for preventing rotative force is provided by the upper surface of the seal plate having high rotative slippage, and/or low rotative friction, between the compact cover and the seal member, which prevents the rotating compact cover from rotating the seal plate, and thereby eliminating any circumferential shear force upon the seat seal ring.

5. The sealable container according to claim 1, wherein the seal plate includes an annular flat groove along the outer periphery, and the seat seal ring is an annular flattened ring made of a silicon material and configured to reside within the flat groove of the circular disk.

6. The sealable container according to claim 5 wherein the seal plate is made of a thermoplastic material that has a low coefficient of friction.

7. The sealable container according to claim 1, wherein the means for preventing rotative force is provided by the seal plate which includes a plurality of projections that engage and bayonet into a plurality of slots formed into an annular flange of the upper rim of the container, to prevent the rotating compact cover from rotating the seal plate, and thereby eliminating any circumferential shear force upon the seat seal ring.

8. The compact device according to claim 3 wherein the lower base includes an annular inner tray disposed outward radially of the hinged ring, the inner tray having a slot within which the hinge support of the hinged ring can rotate relative to the container between the first rotated position and the second rotated position.

9. The compact device according to claim 3, further including an upper outer cover that is hinged to the lower base, to cover the sealable container.

10. The compact device according to claim 3, wherein the lower base, the container, the hinged ring, the compact cover, and the annular seal each have a rotative centerline that align with a common centerline.

11. The sealable container according to claim 1, wherein the series of outwardly-extending thread segments of the container are circumferentially spaced apart and separated by a corresponding series of gaps, wherein the series of inwardly-extending thread segments of the compact cover are angularly aligned with the series of gaps of the container when the compact cover is in the covering position, and the compact cover and the hinged ring are in the first rotated position relative to the container, and the inwardly-extending thread segments of the compact cover are angularly aligned with the series of outwardly-extending thread segments of the container when the compact cover and the hinged ring are in the second rotated position relative to the container.

12. The sealable container according to claim 1, further including a vapor seal layer comprising a seal sheet disposed on an underside of the seat seal ring, and configured to be disposed over and covering the rim of the container when the compact cover is at the covering position, wherein the vapor seal layer is more impervious to organic solvent vapor and water vapor than conventional structure thermoplastic materials.

13. A compact case including a container assembly and a hinged cover assembly that is retained to and rotatable about a central axis relative to the container assembly, the container assembly comprising:

(a) a base including an outer wall having a hinge window, and an upper opening, and (b) a container having an outer wall with thread connections and having a top opening, securable in a fixed position onto a base floor of the base, and extending through the upper opening of the base; and the hinged cover assembly comprising:

(c) an annular hinge ring including an annular inner wall, a platform extending from an upper edge of the inner wall and having an outer periphery, a hinge member extending radially outward from the inner wall, and a veil wall that extends downward from a portion of the outer periphery, and (d) a cover including a cover plate and an annular wall, and a hinge member extending from a portion of said annular wall to hingedly engage the hinge member of the hinged ring to form a hinge for pivoting the cover between an uncovered position and a covering position, wherein the hinge ring is disposed within the base between the outer wall and the container, and the hinged cover assembly is rotatable around the container between a closed position and an open position, and where the veil wall covers the hinge window of the base when the hinge ring is in a closed position, and wherein at the covering position, the cover and the hinge ring are at a closed position relative to the container and the base, at which the veil wall covers the hinge window of the base, and at the opened position, the hinge is in registry with the hinge window, and the cover can be pivoted from the covering position, to the uncovered position at which the hinge extends radially through the hinge window of the base.

14. The compact device according to claim 13, wherein the veil wall is disposed circumferentially adjacent to the hinge member of the hinge ring.

15. The compact device according to claim 3, wherein the means for preventing rotative force is provided by the upper surface of the seal plate having high rotative slippage, and/or low rotative friction, between the compact cover and the seal plate, which prevents the rotating compact cover from rotating the seal plate, and thereby eliminating any circumferential shear force upon the seat seal ring.

16. The compact device according to claim 3, wherein the seal plate includes an annular flat groove along the outer periphery, and the seat seal ring is an annular flattened ring made of a silicon material and configured to reside within the flat groove of the circular disk.

17. The compact device according to claim 16 wherein the seal plate is made of a thermoplastic material that has a low coefficient of friction.

18. The compact device according to claim 3, wherein the means for preventing rotative force is provided by the seal plate which includes a plurality of projections that engage and bayonet into a plurality of slots formed into an annular flange of the upper rim of the container, to prevent the rotating compact cover from rotating the seal plate, and thereby eliminating any circumferential shear force upon the seat seal ring.

19. The compact device according to claim 3, wherein the series of outwardly-extending thread segments of the container are circumferentially spaced apart and separated by a corresponding series of gaps, wherein the series of inwardly-extending thread segments of the compact cover are angularly aligned with the series of gaps of the container when the compact cover is in the covering position, and the compact cover and the hinged ring are in the first rotated position relative to the container, and the inwardly-extending thread segments of the compact cover are angularly aligned with the series of outwardly-extending thread segments of the container when the compact cover and the hinged ring are in the second rotated position relative to the container.

20. The compact device according to claim 3, further including a vapor seal layer comprising a seal sheet disposed on an underside of the seat seal ring, and configured to be disposed over and covering the rim of the container when the compact cover is at the covering position, wherein the vapor seal layer is more impervious to organic solvent vapor and water vapor than conventional structure thermoplastic materials.

* * * * *